US009518445B2

(12) United States Patent
Noske

(10) Patent No.: US 9,518,445 B2
(45) Date of Patent: Dec. 13, 2016

(54) BIDIRECTIONAL DOWNHOLE ISOLATION VALVE

(71) Applicant: Weatherford Technology Holdings, LLC, Houston, TX (US)

(72) Inventor: Joe Noske, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 256 days.

(21) Appl. No.: 14/150,137

(22) Filed: Jan. 8, 2014

(65) Prior Publication Data

US 2014/0202768 A1 Jul. 24, 2014

Related U.S. Application Data

(60) Provisional application No. 61/754,294, filed on Jan. 18, 2013.

(51) Int. Cl.
*E21B 34/06* (2006.01)
*E21B 34/10* (2006.01)

(52) U.S. Cl.
CPC ..... *E21B 34/06* (2013.01); *E21B 34/10* (2013.01); *E21B 34/102* (2013.01)

(58) Field of Classification Search
CPC ..... E21B 34/06; E21B 34/102; E21B 34/10
See application file for complete search history.

(56) References Cited

U.S. PATENT DOCUMENTS 3,780,809 A * 12/1973 Ayers, Jr. ..... E21B 34/108 137/624.11
4,641,707 A * 2/1987 Akkerman ..... E21B 34/102 166/116
4,655,070 A 4/1987 Clift
6,209,663 B1 4/2001 Hosie
6,230,808 B1 5/2001 French et al.
6,328,109 B1 12/2001 Pringle et al.
6,401,826 B2 6/2002 Patel
6,508,309 B1 1/2003 French
6,666,271 B2 12/2003 Deaton et al.
6,808,020 B2 10/2004 Garcia et al.
6,851,477 B2 2/2005 Hill, Jr. et al.
7,673,689 B2 3/2010 Jackson et al.
7,730,968 B2 6/2010 Hosie et al.
7,762,336 B2 7/2010 Johnson et al.
(Continued)

FOREIGN PATENT DOCUMENTS

WO 2011/110816 A2 9/2011

OTHER PUBLICATIONS

PCT International Search Report and Written Opinion dated Feb. 5, 2015, for International Application No. PCT/2014/010975.
(Continued)

*Primary Examiner* — Brad Harcourt
(74) *Attorney, Agent, or Firm* — Patterson & Sheridan, LLP

(57) ABSTRACT

An isolation valve for use in a wellbore includes: a housing; a piston longitudinally movable relative to the housing; a flapper carried by the piston for operation between an open position and a closed position, the flapper operable to isolate an upper portion of a bore of the valve from a lower portion of the bore in the closed position; an opener connected to the housing for opening the flapper; and an abutment configured to receive the flapper in the closed position, thereby retaining the flapper in the closed position.

25 Claims, 16 Drawing Sheets

(56) References Cited

U.S. PATENT DOCUMENTS

| | | | | |
|---|---|---|---|---|
| 7,789,156 | B2 | 9/2010 | Pia | |
| 8,261,836 | B2 | 9/2012 | Noske et al. | |
| 8,579,027 | B2 | 11/2013 | Abdelmalek et al. | |
| 2007/0095546 | A1 | 5/2007 | Farquhar et al. | |
| 2008/0302524 | A1* | 12/2008 | Hosie | E21B 33/0407 166/66.6 |
| 2009/0229829 | A1 | 9/2009 | Lloyd et al. | |
| 2009/0230340 | A1 | 9/2009 | Purkis | |
| 2009/0272539 | A1 | 11/2009 | Lloyd et al. | |
| 2010/0301242 | A1 | 12/2010 | Patton et al. | |
| 2011/0232916 | A1* | 9/2011 | Maldonado | E21B 34/10 166/373 |
| 2012/0067595 | A1 | 3/2012 | Noske et al. | |
| 2012/0234558 | A1 | 9/2012 | Godfrey et al. | |
| 2013/0068476 | A1 | 3/2013 | Edwards | |

OTHER PUBLICATIONS

Canadian Office Action dated May 31, 2016, for Canadian Patent Application No. 2,898,461.

* cited by examiner

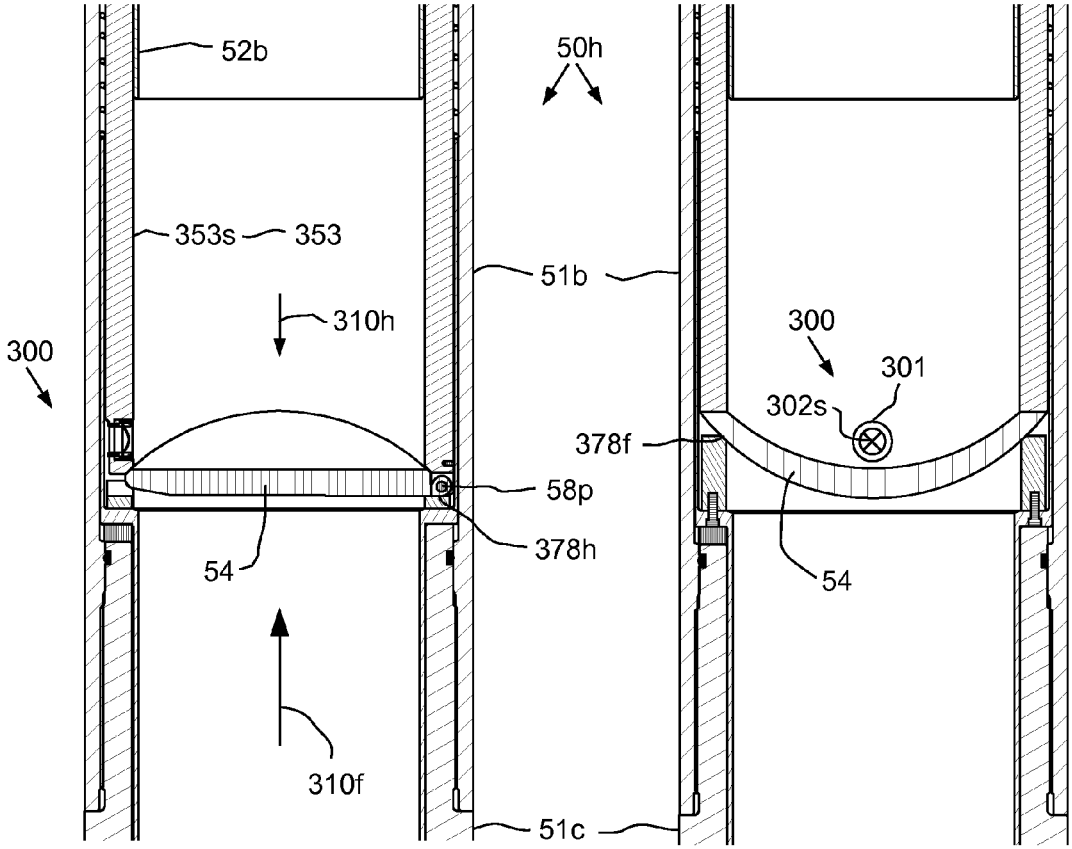
FIG. 11A
FIG. 11B
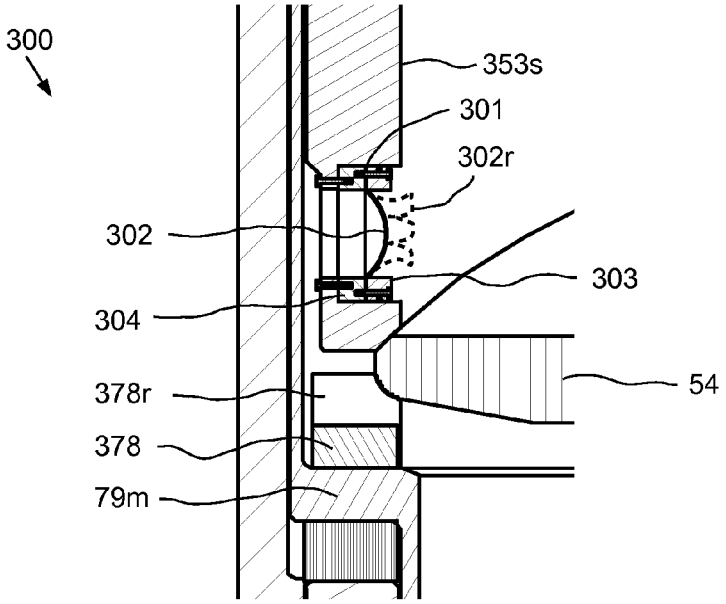
FIG. 11C

BIDIRECTIONAL DOWNHOLE ISOLATION VALVE

BACKGROUND OF THE DISCLOSURE

Field of the Disclosure

The present disclosure generally relates to a bidirectional downhole isolation valve.

Description of the Related Art

A hydrocarbon bearing formation (i.e., crude oil and/or natural gas) is accessed by drilling a wellbore from a surface of the earth to the formation. After the wellbore is drilled to a certain depth, steel casing or liner is typically inserted into the wellbore and an annulus between the casing/liner and the earth is filled with cement. The casing/liner strengthens the borehole, and the cement helps to isolate areas of the wellbore during further drilling and hydrocarbon production.

Once the wellbore has reached the formation, the formation is then usually drilled in an overbalanced condition meaning that the annulus pressure exerted by the returns (drilling fluid and cuttings) is greater than a pore pressure of the formation. Disadvantages of operating in the overbalanced condition include expense of the weighted drilling fluid and damage to formations by entry of the mud into the formation. Therefore, underbalanced or managed pressure drilling may be employed to avoid or at least mitigate problems of overbalanced drilling. In underbalanced and managed pressure drilling, a lighter drilling fluid is used so as to prevent or at least reduce the drilling fluid from entering and damaging the formation. Since underbalanced and managed pressure drilling are more susceptible to kicks (formation fluid entering the annulus), underbalanced and managed pressure wellbores are drilled using a rotating control device (RCD) (aka rotating diverter, rotating BOP, or rotating drilling head). The RCD permits the drill string to be rotated and lowered therethrough while retaining a pressure seal around the drill string.

An isolation valve as part of the casing/liner may be used to temporarily isolate a formation pressure below the isolation valve such that a drill or work string may be quickly and safely inserted into a portion of the wellbore above the isolation valve that is temporarily relieved to atmospheric pressure. The isolation valve allows a drill/work string to be tripped into and out of the wellbore at a faster rate than snubbing the string in under pressure. Since the pressure above the isolation valve is relieved, the drill/work string can trip into the wellbore without wellbore pressure acting to push the string out. Further, the isolation valve permits insertion of the drill/work string into the wellbore that is incompatible with the snubber due to the shape, diameter and/or length of the string.

Typical isolation valves are unidirectional, thereby sealing against formation pressure below the valve but not remaining closed should pressure above the isolation valve exceed the pressure below the valve. This unidirectional nature of the valve may complicate insertion of the drill or work string into the wellbore due to pressure surge created during the insertion. The pressure surge may momentarily open the valve allowing an influx of formation fluid to leak through the valve.

SUMMARY OF THE DISCLOSURE

The present disclosure generally relates to a bidirectional downhole isolation valve. In one embodiment, an isolation valve for use in a wellbore includes: a housing; a piston longitudinally movable relative to the housing; a flapper carried by the piston for operation between an open position and a closed position, the flapper operable to isolate an upper portion of a bore of the valve from a lower portion of the bore in the closed position; an opener connected to the housing for opening the flapper; and an abutment configured to receive the flapper in the closed position, thereby retaining the flapper in the closed position.

In another embodiment, a method of drilling a wellbore includes: deploying a drill string into the wellbore through a casing string disposed in the wellbore, the casing string having an isolation valve; drilling the wellbore into a formation by injecting drilling fluid through the drill string and rotating a drill bit of the drill sting; retrieving the drill string from the wellbore until the drill bit is above a flapper of the isolation valve; and closing the flapper by supplying hydraulic fluid to a piston of the isolation valve, the piston carrying the closed flapper into engagement with an abutment of the isolation valve and bidirectionally isolating the formation from an upper portion of the wellbore.

In another embodiment, an isolation assembly for use in a wellbore, includes an isolation valve and a power sub for opening and/or closing the isolation valve. The isolation valve includes: a housing; a first piston longitudinally movable relative to the housing; a flapper for operation between an open position and a closed position, the flapper operable to isolate an upper portion of a bore of the valve from a lower portion of the bore in the closed position; a sleeve for opening the flapper; and a pressure relief device set at a design pressure of the flapper and operable to bypass the closed flapper. The power sub includes: a tubular housing having a bore formed therethrough; a tubular mandrel disposed in the power sub housing, movable relative thereto, and having a profile formed through a wall thereof for receiving a driver of a shifting tool; and a piston operably coupled to the mandrel and operable to pump hydraulic fluid to the isolation valve piston.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIGS. 11A-11C illustrate another modified isolation valve having a pressure relief device, according to another embodiment of the present disclosure.

DETAILED DESCRIPTION

Figure 1A:
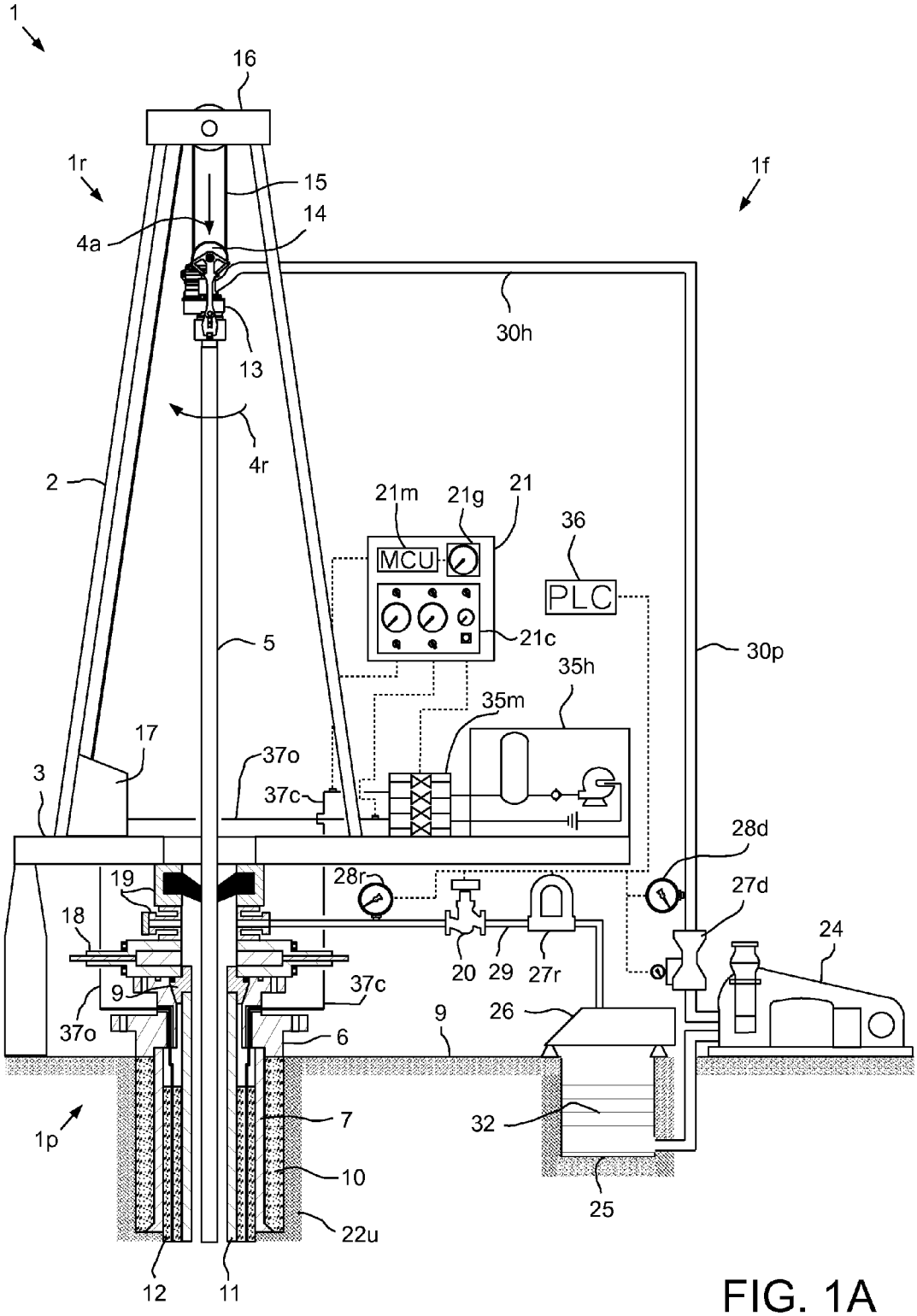
FIGS. 1A and 1B illustrates operation of a terrestrial drilling system in a drilling mode, according to one embodiment of the present disclosure.
Figure 1B:
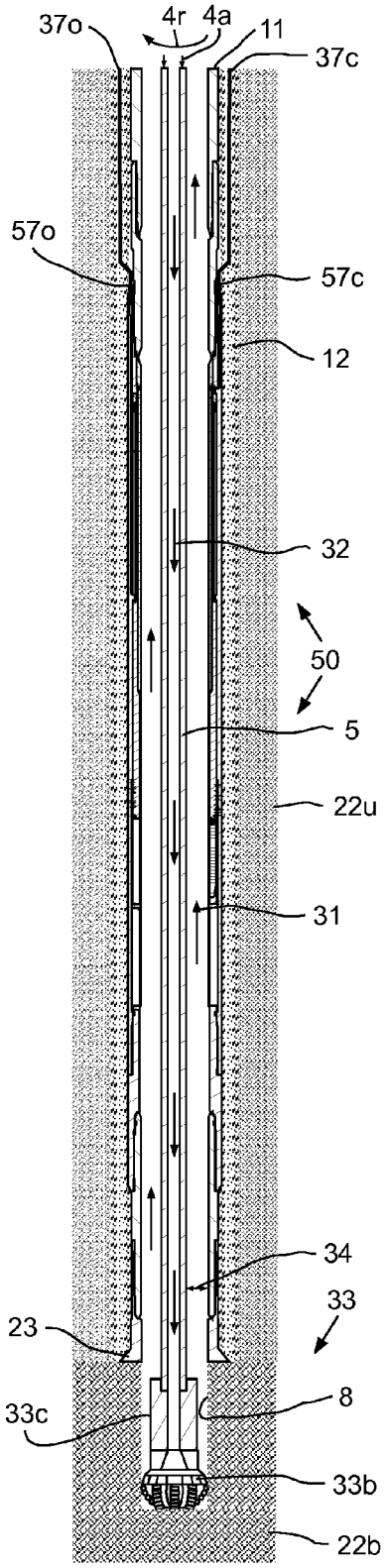
Figure 9A:
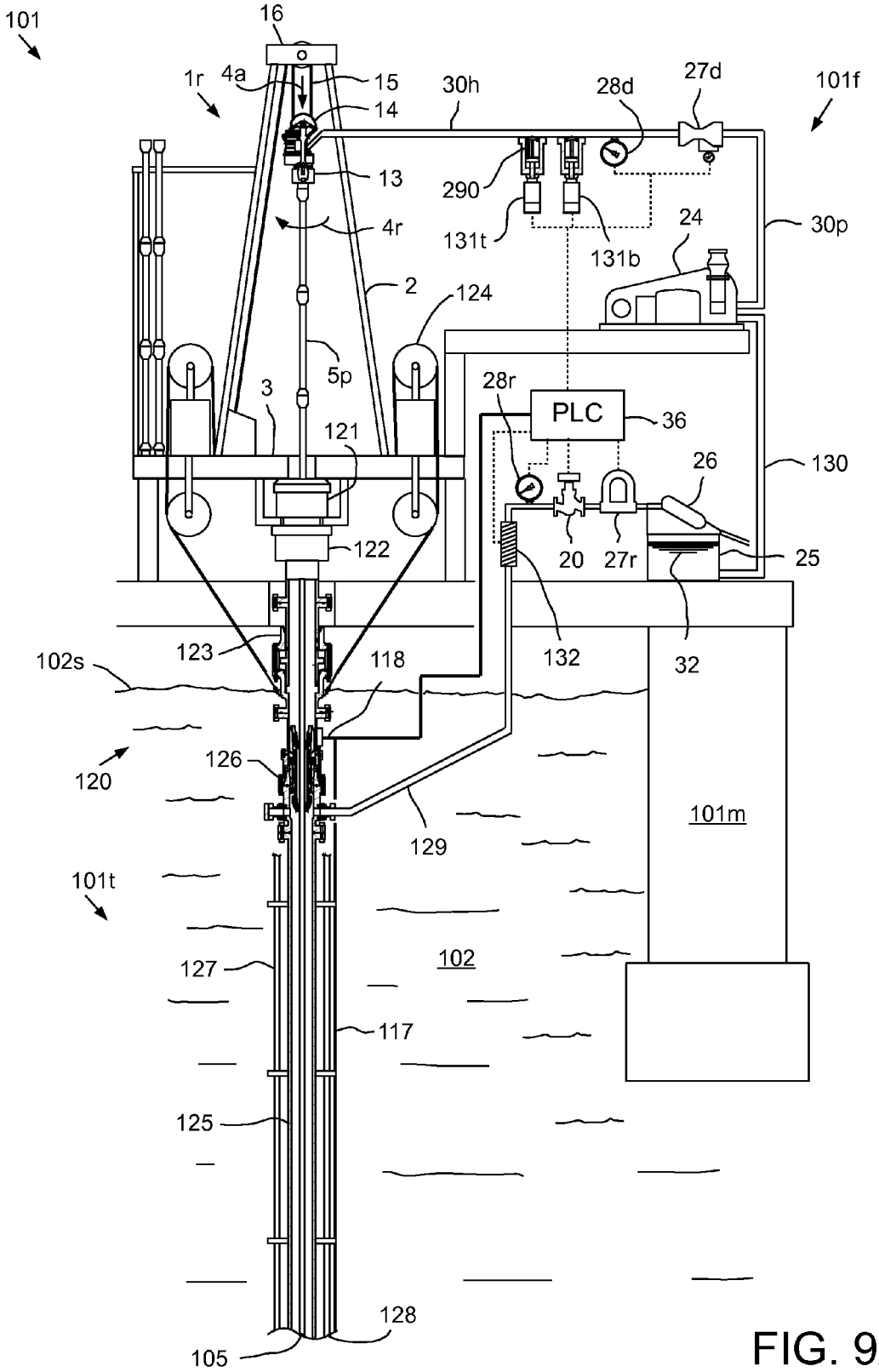
FIGS. 9A-9D illustrate operation of an offshore drilling system in a tripping mode, according to another embodiment of the present disclosure.
Figure 9B:
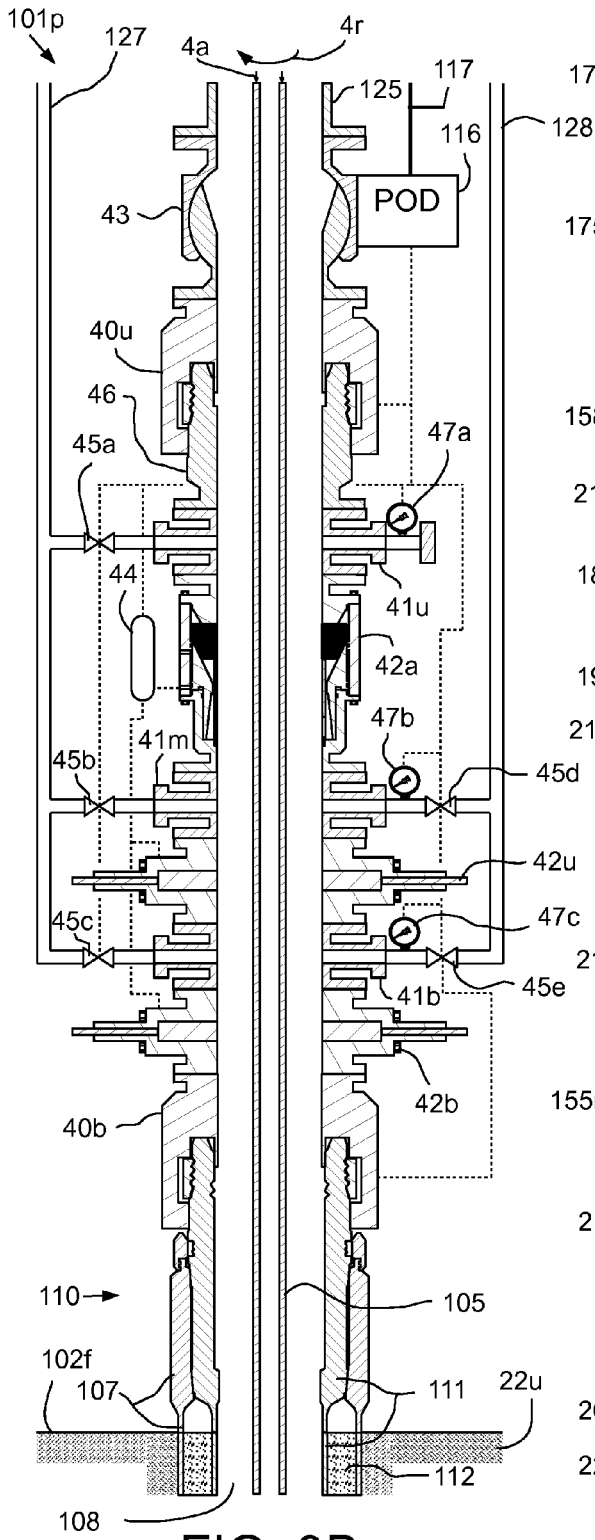

FIGS. 1A and 1B illustrates operation of a terrestrial drilling system 1 in a drilling mode, according to one embodiment of the present disclosure. The drilling system 1 may include a drilling rig 1*r*, a fluid handling system 1*f*, and a pressure control assembly (PCA) 1*p*. The drilling rig 1*r* may include a derrick 2 having a rig floor 3 at its lower end having an opening through which a drill string 5 extends downwardly into the PCA 1*p*. The PCA 1*p* may be connected to a wellhead 6. The drill string 5 may include a bottomhole assembly (BHA) 33 and a conveyor string. The conveyor string may include joints of drill pipe 5*p* (FIG. 9A) connected together, such as by threaded couplings. The BHA 33 may be connected to the conveyor string, such as by threaded couplings, and include a drill bit 33*b* and one or more drill collars 33*c* connected thereto, such as by threaded couplings. The drill bit 33*b* may be rotated 4*r* by a top drive 13 via the drill pipe 5*p* and/or the BHA 33 may further include a drilling motor (not shown) for rotating the drill bit. The BHA 33 may further include an instrumentation sub (not shown), such as a measurement while drilling (MWD) and/or a logging while drilling (LWD) sub.

An upper end of the drill string 5 may be connected to a quill of the top drive 13. The top drive 13 may include a motor for rotating 4*r* the drill string 5. The top drive motor may be electric or hydraulic. A frame of the top drive 13 may be coupled to a rail (not shown) of the derrick 2 for preventing rotation of the top drive housing during rotation of the drill string 5 and allowing for vertical movement of the top drive with a traveling block 14. The frame of the top drive 13 may be suspended from the derrick 2 by the traveling block 14. The traveling block 14 may be supported by wire rope 15 connected at its upper end to a crown block 16. The wire rope 15 may be woven through sheaves of the blocks 14, 16 and extend to drawworks 17 for reeling thereof, thereby raising or lowering the traveling block 14 relative to the derrick 2.

Alternatively, the wellbore may be subsea having a wellhead located adjacent to the waterline and the drilling rig may be a located on a platform adjacent the wellhead. Alternatively, a Kelly and rotary table (not shown) may be used instead of the top drive.

The PCA 1 p may include a blow out preventer (BOP) 18, a rotating control device (RCD) 19, a variable choke valve 20, a control station 21, a hydraulic power unit (HPU) 35*h*, a hydraulic manifold 35*m*, one or more control lines 37*o,c*, and an isolation valve 50. A housing of the BOP 18 may be connected to the wellhead 6, such as by a flanged connection. The BOP housing may also be connected to a housing of the RCD 19, such as by a flanged connection. The RCD 19 may include a stripper seal and the housing. The stripper seal may be supported for rotation relative to the housing by bearings. The stripper seal-housing interface may be isolated by seals. The stripper seal may form an interference fit with an outer surface of the drill string 5 and be directional for augmentation by wellbore pressure. The choke 20 may be connected to an outlet of the RCD 19. The choke 20 may include a hydraulic actuator operated by a programmable logic controller (PLC) 36 via a second hydraulic power unit (HPU) (not shown) to maintain backpressure in the wellhead 6. Alternatively, the choke actuator may be electrical or pneumatic.

The wellhead 6 may be mounted on an outer casing string 7 which has been deployed into a wellbore 8 drilled from a surface 9 of the earth and cemented 10 into the wellbore. An inner casing string 11 has been deployed into the wellbore 8, hung 9 from the wellhead 6, and cemented 12 into place. The inner casing string 11 may extend to a depth adjacent a bottom of an upper formation 22*u*. The upper formation 22*u* may be non-productive and a lower formation 22*b* may be a hydrocarbon-bearing reservoir. Alternatively, the lower formation 22*b* may be environmentally sensitive, such as an aquifer, or unstable. The inner casing string 11 may include a casing hanger 9, a plurality of casing joints connected together, such as by threaded couplings, the isolation valve 50, and a guide shoe 23. The control lines 37*o,c* may be fastened to the inner casing string 11 at regular intervals. The control lines 37*o,c* may be bundled together as part of an umbilical.

The control station 21 may include a console 21*c*, a microcontroller (MCU) 21*m*, and a display, such as a gauge 21*g*, in communication with the microcontroller 21*m*. The console 21*c* may be in communication with the manifold 35*m* via an operation line and be in fluid communication with the control lines 37*o,c* via respective pressure taps. The console 21*c* may have controls for operation of the manifold 35*m* by the technician and have gauges for displaying pressures in the respective control lines 37*o,c* for monitoring by the technician. The control station 21 may further include a pressure sensor (not shown) in fluid communication with the closing line 37*c* via a pressure tap and the MCU 21*m* may be in communication with the pressure sensor to receive a pressure signal therefrom.

The fluid system if may include a mud pump 24, a drilling fluid reservoir, such as a pit 25 or tank, a degassing spool (not shown), a solids separator, such as a shale shaker 26, one or more flow meters 27*d,r*, one or more pressure sensors 28*d,r*, a return line 29, and a supply line 30*h,p*. A first end of the return line 29 may be connected to the RCD outlet and a second end of the return line may be connected to an inlet of the shaker 26. The returns pressure sensor 28*r*, choke 20, and returns flow meter 27*r* may be assembled as part of the return line 29. A lower end of the supply line 30*p,h* may be connected to an outlet of the mud pump 24 and an upper end of the supply line may be connected to an inlet of the top drive 13. The supply pressure sensor 28*d* and supply flow meter 27*d* may be assembled as part of the supply line 30*p,h*.

Each pressure sensor 28*d,r* may be in data communication with the PLC 36. The returns pressure sensor 28*r* may be connected between the choke 20 and the RCD outlet port and may be operable to monitor wellhead pressure. The supply pressure sensor 28*d* may be connected between the mud pump 24 and a Kelly hose 30*h* of the supply line 30*p,h* and may be operable to monitor standpipe pressure. The returns 27*r* flow meter may be a mass flow meter, such as a Coriolis flow meter, and may each be in data communication with the PLC 36. The returns flow meter 27*r* may be connected between the choke 20 and the shale shaker 26 and may be operable to monitor a flow rate of drilling returns 31. The supply 27*d* flow meter may be a volumetric flow meter, such as a Venturi flow meter, and may be in data communication with the PLC 36. The supply flow meter 27*d* may be connected between the mud pump 24 and the Kelly hose 30*h* and may be operable to monitor a flow rate of the mud pump. The PLC 36 may receive a density measurement of drilling fluid 32 from a mud blender (not shown) to determine a mass flow rate of the drilling fluid from the volumetric measurement of the supply flow meter 27*d*.

Alternatively, a stroke counter (not shown) may be used to monitor a flow rate of the mud pump instead of the supply flow meter. Alternatively, the supply flow meter may be a mass flow meter.

To extend the wellbore 8 from the casing shoe 23 into the lower formation 22*b*, the mud pump 24 may pump the drilling fluid 32 from the pit 25, through standpipe 30*p* and Kelly hose 30*h* to the top drive 13. The drilling fluid 32 may include a base liquid. The base liquid may be refined or synthetic oil, water, brine, or a water/oil emulsion. The drilling fluid 32 may further include solids dissolved or suspended in the base liquid, such as organophilic clay, lignite, and/or asphalt, thereby forming a mud.

Alternatively, the drilling fluid 32 may further include a gas, such as diatomic nitrogen mixed with the base liquid, thereby forming a two-phase mixture. Alternatively, the drilling fluid may be a gas, such as nitrogen, or gaseous, such as a mist or foam. If the drilling fluid 32 includes gas, the drilling system 1 may further include a nitrogen production unit (not shown) operable to produce commercially pure nitrogen from air.

The drilling fluid 32 may flow from the supply line 30*p,h* and into the drill string 5 via the top drive 13. The drilling fluid 32 may be pumped down through the drill string 5 and exit a drill bit 33*b*, where the fluid may circulate the cuttings away from the bit and return the cuttings up an annulus 34 formed between an inner surface of the inner casing 11 or wellbore 8 and an outer surface of the drill string 10. The returns 31 (drilling fluid plus cuttings) may flow up the annulus 34 to the wellhead 6 and be diverted by the RCD 19 into the RCD outlet. The returns 31 may continue through the choke 20 and the flow meter 27*r*. The returns 31 may then flow into the shale shaker 26 and be processed thereby to remove the cuttings, thereby completing a cycle. As the drilling fluid 32 and returns 31 circulate, the drill string 5 may be rotated 4*r* by the top drive 13 and lowered 4*a* by the traveling block 14, thereby extending the wellbore 8 into the lower formation 22*b*.

A static density of the drilling fluid 32 may correspond to a pore pressure gradient of the lower formation 22*b* and the PLC 36 may operate the choke 20 such that an underbalanced, balanced, or slightly overbalanced condition is maintained during drilling of the lower formation 22*b*. During the drilling operation, the PLC 36 may also perform a mass balance to ensure control of the lower formation 22*b*. As the drilling fluid 32 is being pumped into the wellbore 8 by the mud pump 24 and the returns 31 are being received from the return line 29, the PLC 36 may compare the mass flow rates (i.e., drilling fluid flow rate minus returns flow rate) using the respective flow meters 27*d,r*. The PLC 36 may use the mass balance to monitor for formation fluid (not shown) entering the annulus 34 (some ingress may be tolerated for underbalanced drilling) and contaminating the returns 31 or returns entering the formation 22*b*.

Upon detection of a kick or lost circulation, the PLC 36 may take remedial action, such as diverting the flow of returns 31 from an outlet of the returns flow meter 27*r* to the degassing spool. The degassing spool may include automated shutoff valves at each end, a mud-gas separator (MGS), and a gas detector. A first end of the degassing spool may be connected to the return line 29 between the returns flow meter 27*r* and the shaker 26 and a second end of the degasser spool may be connected to an inlet of the shaker. The gas detector may include a probe having a membrane for sampling gas from the returns 31, a gas chromatograph, and a carrier system for delivering the gas sample to the chromatograph. The MGS may include an inlet and a liquid outlet assembled as part of the degassing spool and a gas outlet connected to a flare or a gas storage vessel. The PLC 36 may also adjust the choke 20 accordingly, such as tightening the choke in response to a kick and loosening the choke in response to loss of the returns.

Figure 2C:
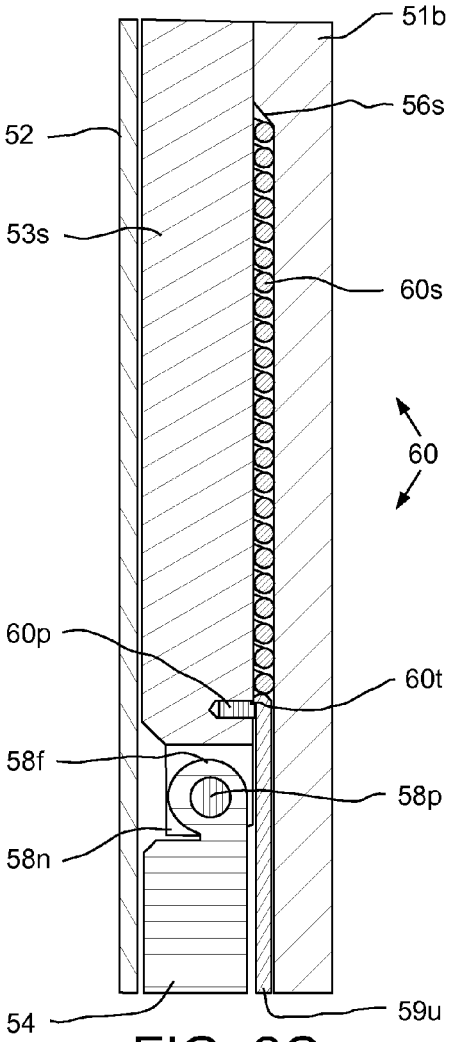
FIG. 2C illustrates a linkage of the isolation valve.
Figure 2D:
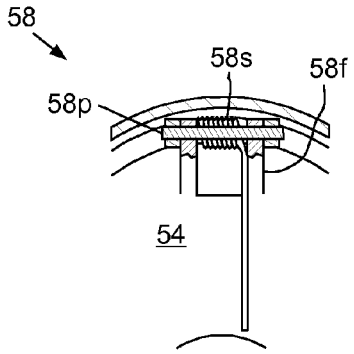
FIG. 2D illustrates a hinge of the isolation valve.
Figure 2A:
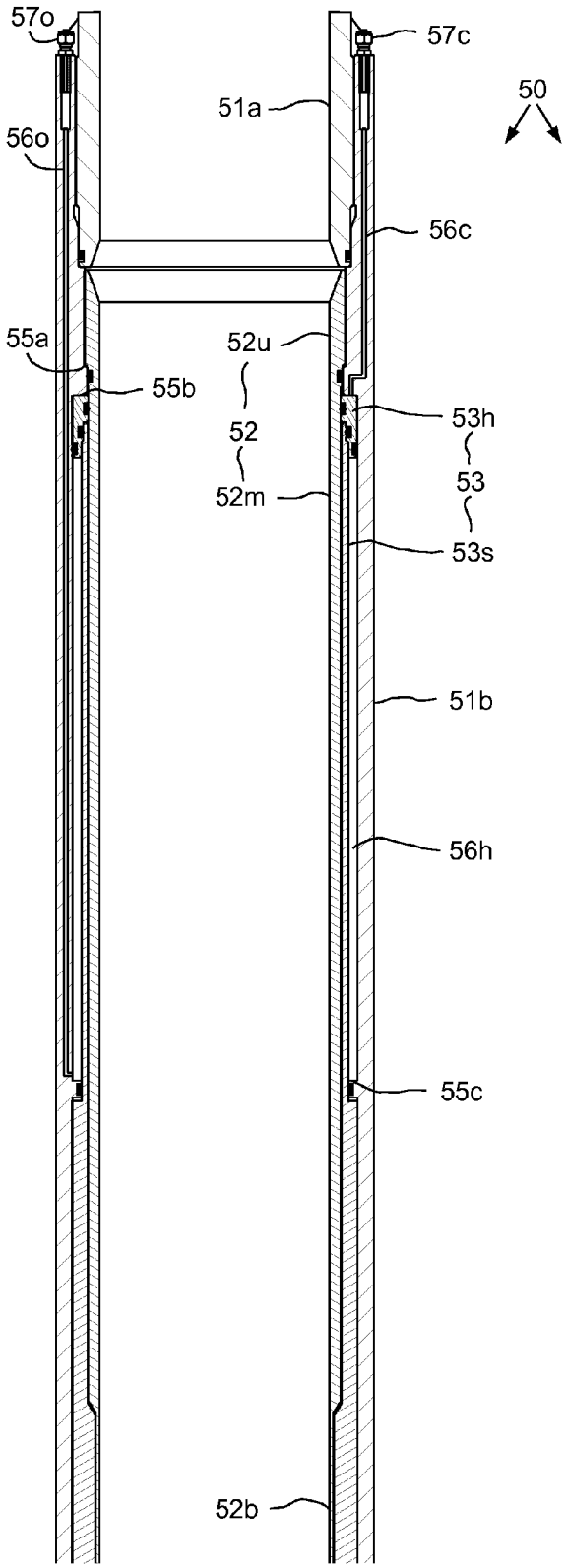
FIGS. 2A and 2B illustrate an isolation valve of the drilling system in an open position.
Figure 2B:
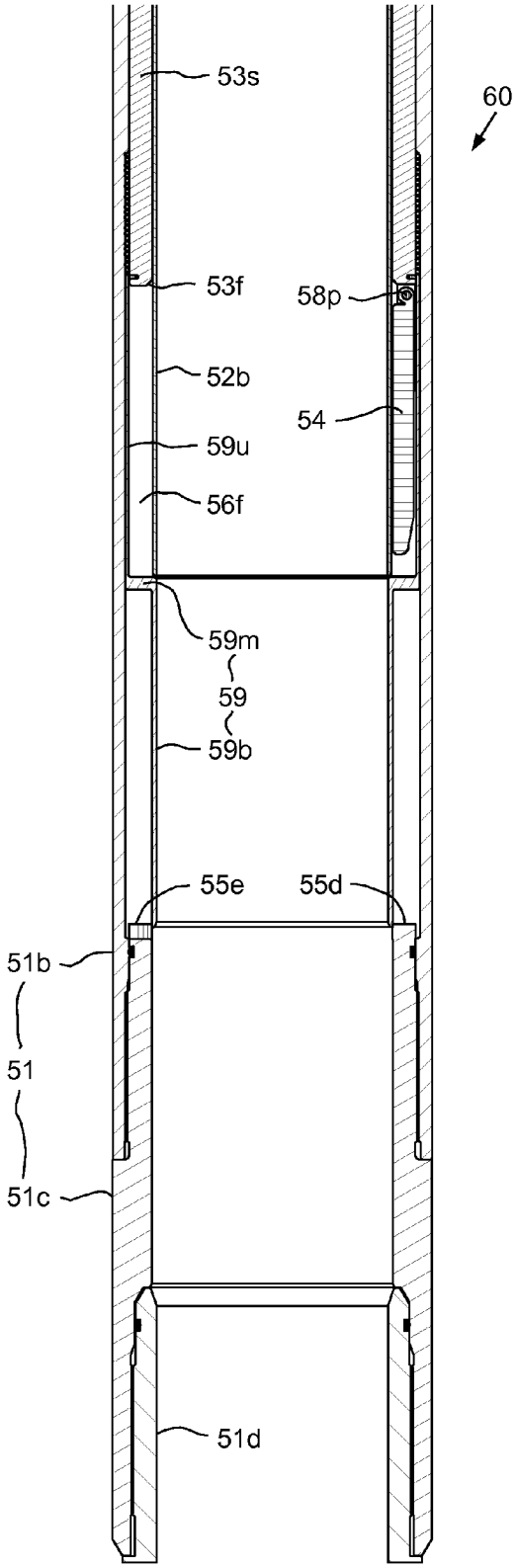
Figures 3A, 3B, 3C:
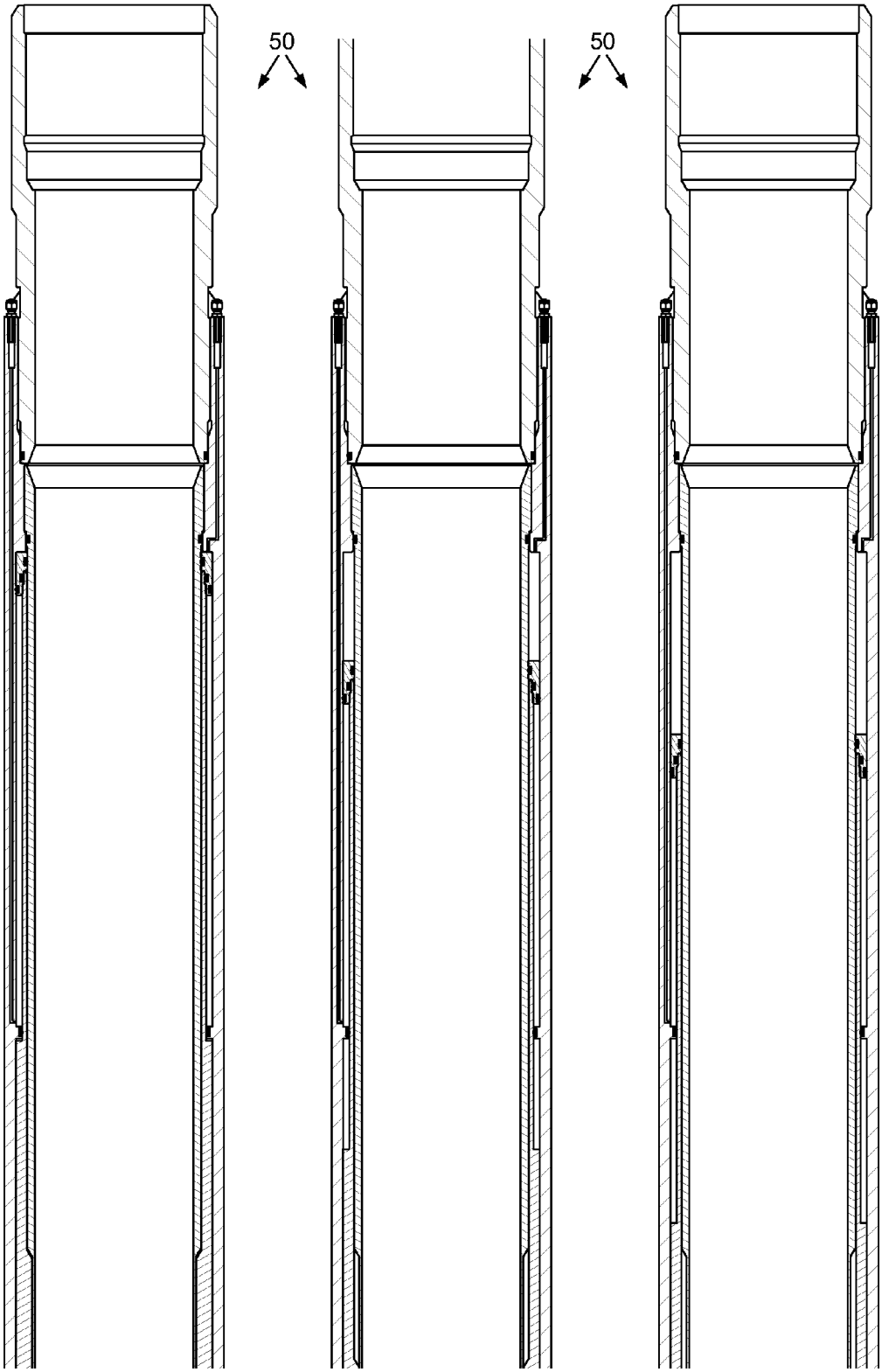
FIGS. 3A-3F illustrate closing of an upper portion of the isolation valve.
Figures 3D, 3E, 3F:
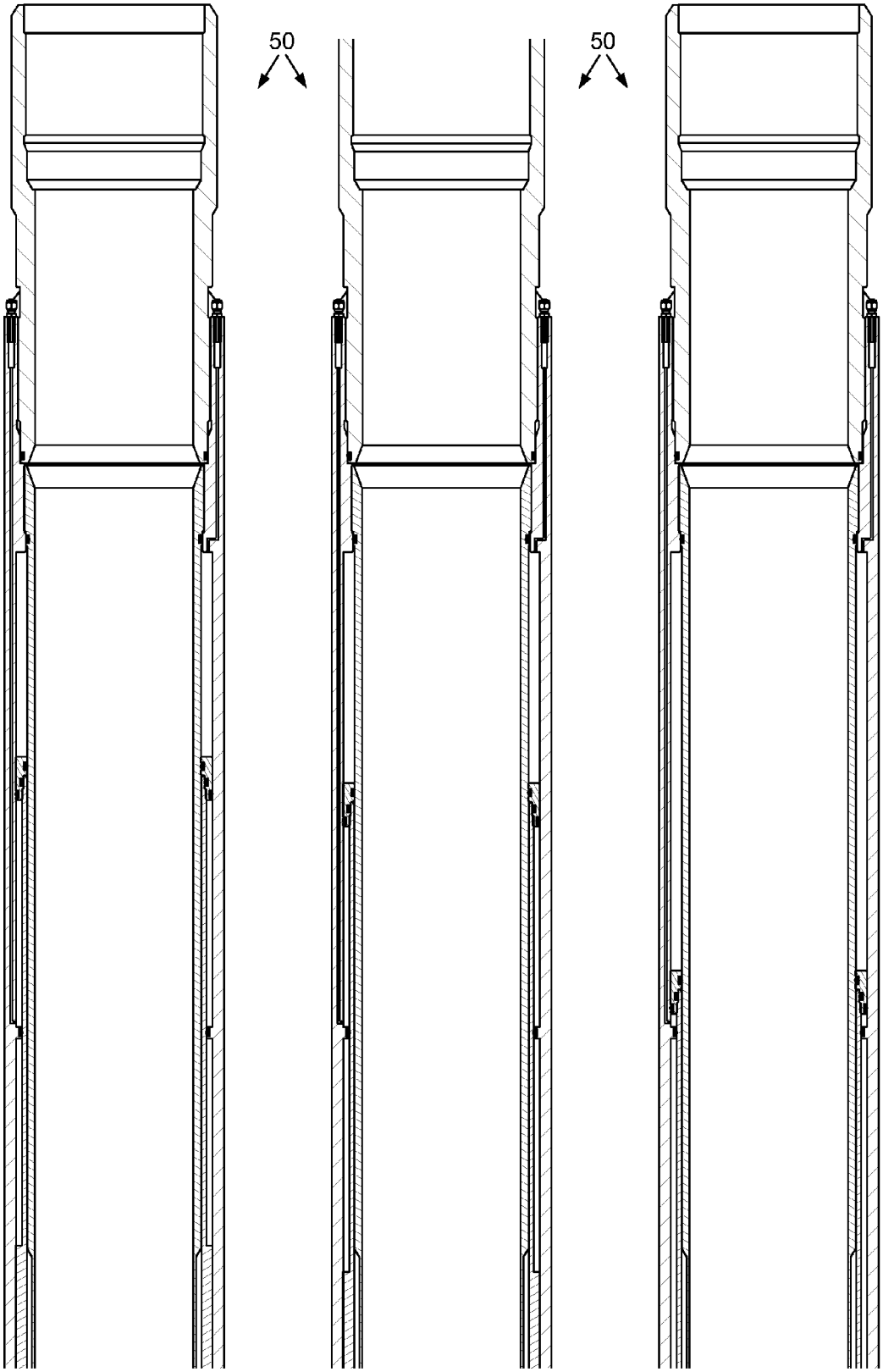
Figures 4A, 4B, 4C:
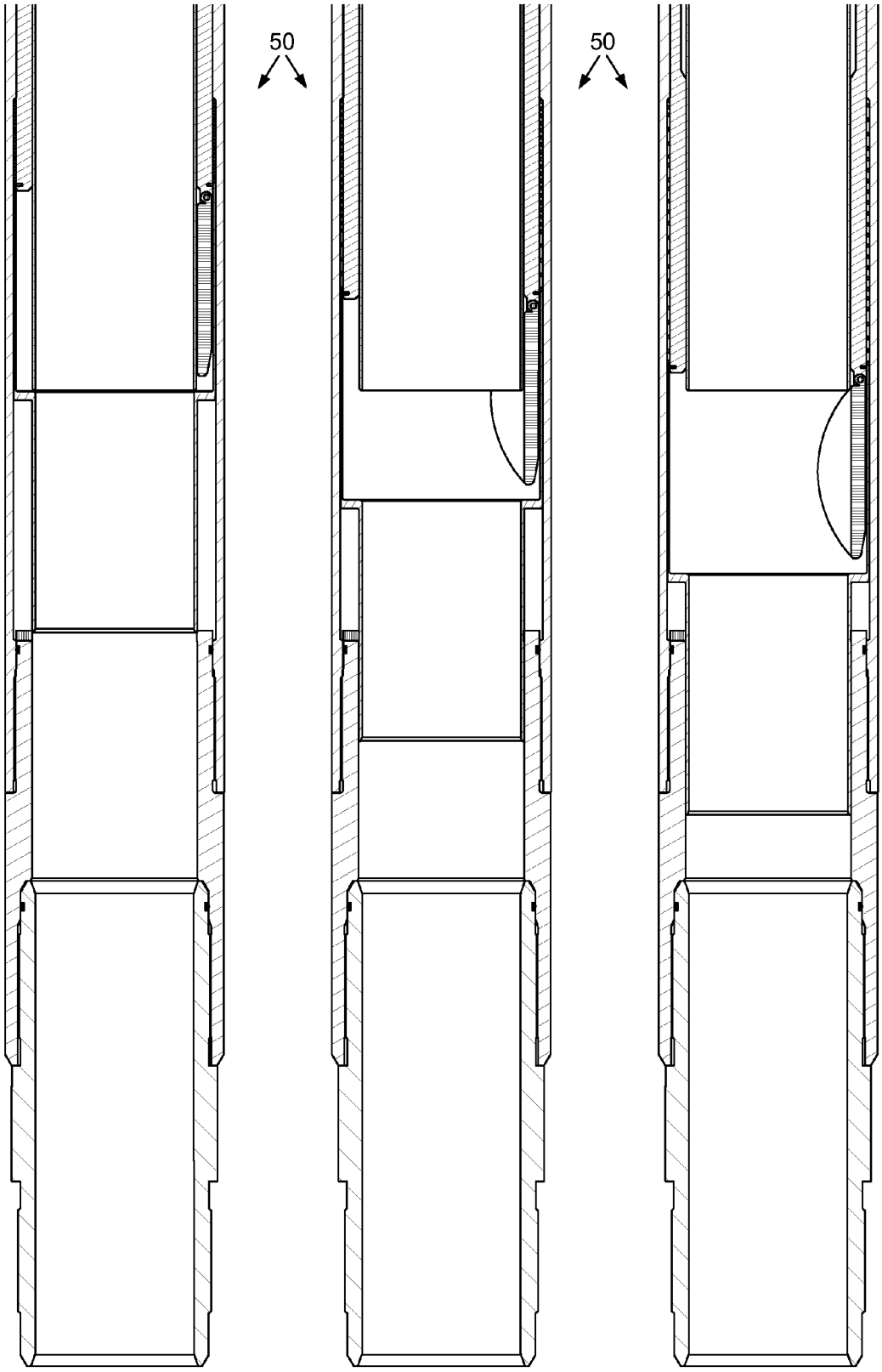
FIGS. 4A-4F illustrate closing of a lower portion of the isolation valve.

FIGS. 2A and 2B illustrate the isolation valve 50 in an open position. The isolation valve 50 may include a tubular housing 51, an opener, such as flow sleeve 52, a piston 53, a closure member, such as a flapper 54, and an abutment, such as a shoulder 59*m*. To facilitate manufacturing and assembly, the housing 51 may include one or more sections 51*a-d* each connected together, such as fastened with threaded couplings and/or fasteners. The valve 50 may include a seal at each housing connection for sealing the respective connection. An upper adapter 51*a* and a lower adapter 51*d* of the housing 51 may each have a threaded coupling (FIGS. 3A and 4A), such as a pin or box, for connection to other members of the inner casing string 11. The valve 50 may have a longitudinal bore therethrough for passage of the drill string 5.

The flow sleeve 52 may have a larger diameter upper portion 52*u*, a smaller diameter lower portion 52*b*, and a mid portion 52*m* connecting the upper and lower portions. The flow sleeve 52 may be disposed within the housing 51 and longitudinally connected thereto, such as by entrapment of the upper portion 52*u* between a bottom of the upper adapter 51*a* and a first shoulder 55*a* formed in an inner surface of a body 51*b* of the housing 51. The flow sleeve 52 may carry a seal for sealing the connection with the housing 51. The piston 53 may be longitudinally movable relative to the housing 51. The piston 53 may include a head 53*h* and a sleeve 53*s* longitudinally connected to the head, such as fastened with threaded couplings and/or fasteners. The piston head 53*h* may carry one or more (three shown) seals for sealing interfaces formed between: the head and the flow sleeve 52, the head and the piston sleeve 53*s*, and the head and the body 51*b*.

A hydraulic chamber 56*h* may be formed in an inner surface of the body 51*b*. The housing 51 may have second 55*b* and third 55*c* shoulders formed in an inner surface thereof and the third shoulder may carry a seal for sealing an interface between the body 51*b* and the piston sleeve 53*s*. The chamber 56*h* may be defined radially between the flow sleeve 52 and the body 51*b* and longitudinally between the second 55*b* and 55*c* third shoulders. Hydraulic fluid may be disposed in the chamber 56*h*. Each end of the chamber 56*h* may be in fluid communication with a respective hydraulic coupling 57*o,c* via a respective hydraulic passage 56*o,c* formed through a wall of the body 51*b*.

Figures 4D, 4E, 4F:
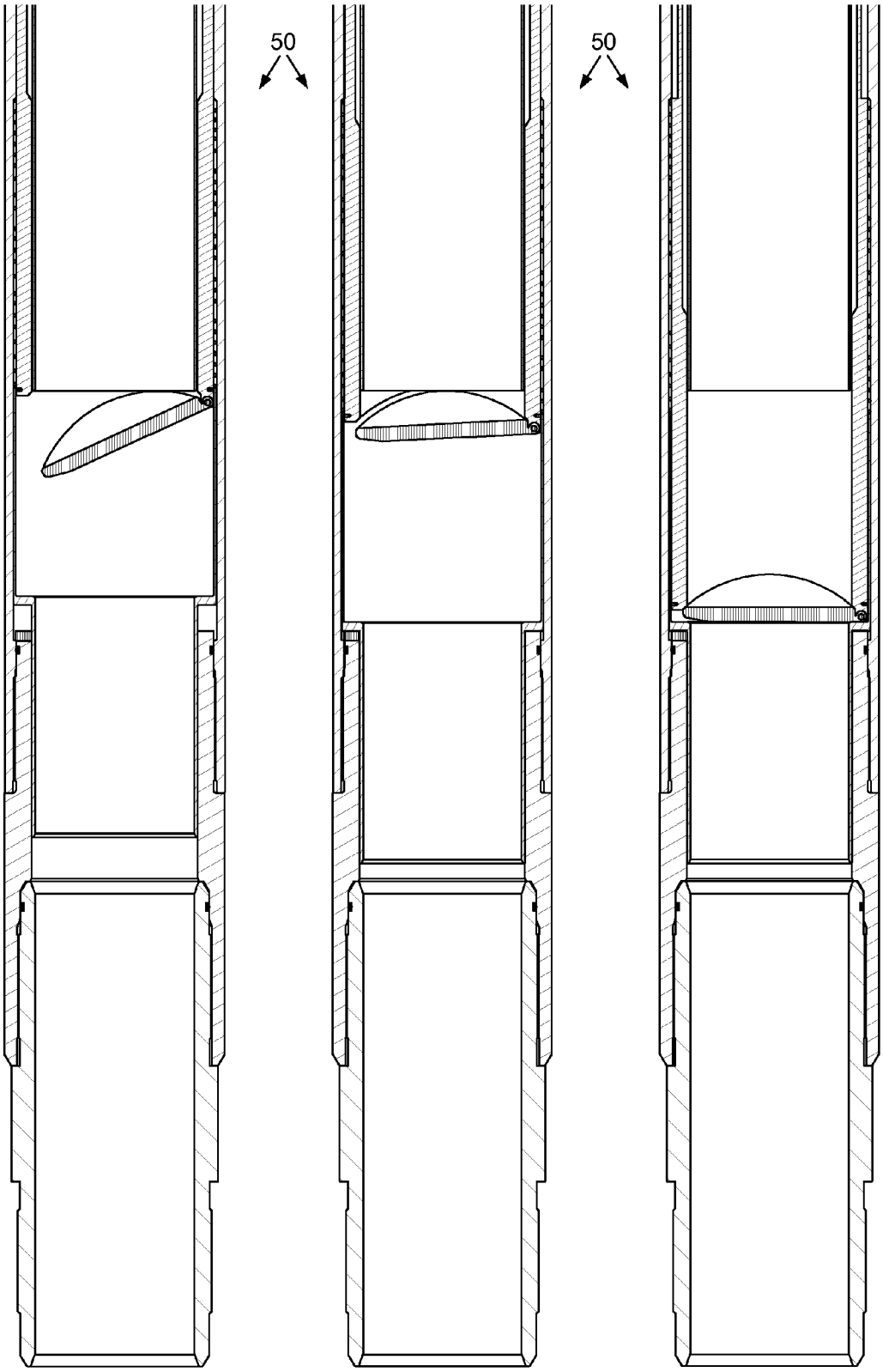

FIG. 2D illustrates a hinge 58 of the isolation valve 50. The isolation valve 50 may further include the hinge 58. The flapper 54 may be pivotally connected to the piston sleeve 53*s*, such as by the hinge 58. The hinge 58 may include one or more knuckles 58*f* formed at an upper end of the flapper 54, one or more knuckles 58*n* formed at a bottom of the piston sleeve 53*s*, a fastener, such as hinge pin 58*p*, extending through holes of the knuckles, and a spring, such as torsion spring 58*s*. The flapper 54 may pivot about the hinge 58 between an open position (shown) and a closed position (FIG. 4F). The flapper 54 may have an undercut formed in at least a portion of an outer face thereof to facilitate pivoting between the positions and ensuring that a seal is not unintentionally formed between the flapper and the shoulder 59*m*. The torsion spring 58*s* may be wrapped around the hinge pin 58*p* and have ends in engagement with the flapper 54 and the piston sleeve 53*s* so as to bias the flapper toward the closed position. The piston sleeve 53*s* may also have a seat 53*f* formed at a bottom thereof. An inner periphery of the flapper 54 may engage the seat 53*f* in the closed position, thereby isolating an upper portion of the valve bore from a lower portion of the valve bore. The interface between the flapper 54 and the seat 53*f* may be a metal to metal seal.

The flapper 54 may be opened and closed by longitudinal movement with the piston 53 and interaction with the flow sleeve 52. Upward movement of the piston 53 may engage the flapper 54 with a bottom of the flow sleeve 52, thereby pushing the flapper 54 to the open position and moving the flapper behind the flow sleeve for protection from the drill string 5. Downward movement of the piston 53 may move the flapper 54 away from the flow sleeve 52 until the flapper is clear of the flow sleeve lower portion 52*b*, thereby allowing the torsion spring 58*s* to close the flapper. In the closed position, the flapper 54 may fluidly isolate an upper portion of the valve bore from a lower portion of the valve bore.

FIG. 2C illustrates a linkage 60 of the isolation valve 50. The isolation valve 50 may further include the linkage 60 and a lock sleeve 59. The lock sleeve 59 may have a larger diameter upper portion 59*u*, a smaller diameter lower portion 59*b*, and the shoulder portion 59*m* connecting the upper and lower portions. The lock sleeve 59 may interact with the housing 51 and the piston 53 via the linkage 60. A spring chamber 56*s* may also be formed in an inner surface of the body 51*b*. The linkage 60 may include one or more fasteners, such as pins 60*p*, carried by the piston sleeve 53*s* adjacent a bottom of the piston sleeve 53*s*, a lip 60*t* formed in an inner surface of the upper lock sleeve portion 59*u* adjacent a top thereof, and a linear spring 60*s* disposed in the spring chamber 56*s*. An upper end of the linear spring 60*s* may be engaged with the body 51*b* and a lower end of the linear spring may be engaged with the top of the lock sleeve 59 so as to bias the lock sleeve away from the body 51*b* and into engagement with the linkage pin 60*p*.

Referring back to FIGS. 2A and 2B, the lock case 51*c* of the housing 51 may have a landing profile 55*d,e* formed in a top thereof for receiving a lower face of the lock sleeve shoulder 59*m*. The landing profile 55*d,e* may include a solid portion 55*d* and one or more openings 55*e*. An upper face of the lock sleeve shoulder 59*m* may receive the closed flapper 54. When the piston 53 is in an upper position (shown), the lock sleeve shoulder 59*m* may be positioned adjacent the flow sleeve bottom, thereby forming a flapper chamber 56*f* between the flow sleeve 52 and the lock sleeve upper portion 59*u*. The flapper chamber 56*f* may protect the flapper 54 and the flapper seat 53*f* from being eroded and/or the linkage 60 fouled by cuttings in the drilling returns 31. The flapper 54 may have a curved shape (FIG. 4C) to conform to the annular shape of the flapper chamber 56*f* and the flapper seat 53*f* may have a curved shape (FIG. 4E) complementary to the flapper curvature.

FIGS. 3A-3F illustrate closing of an upper portion of the isolation valve 50. FIGS. 4A-4F illustrate closing of a lower portion of the isolation valve 50. After drilling of the lower formation 22*b* to total depth, the drill string 5 may be removed from the wellbore 8. Alternatively, the drill string 5 may need to be removed for other reasons before reaching total depth, such as for replacement of the drill bit 33*b*. The drill string 5 may be raised until the drill bit 33*b* is above the flapper 54.

The technician may then operate the control station to supply pressurized hydraulic fluid from an accumulator of the HPU 35*h* to an upper portion of the hydraulic chamber 53*h* and to relieve hydraulic fluid from a lower portion of the hydraulic chamber 53*h* to a reservoir of the HPU. The pressurized hydraulic fluid may flow from the manifold 35*m* through the wellhead 6 and into the wellbore via the closer line 37*c*. The pressurized hydraulic fluid may flow down the closer line 37*c* and into the passage 56*c* via the hydraulic coupling 57*c*. The hydraulic fluid may exit the passage 56*c* into the hydraulic chamber upper portion and exert pressure on an upper face of the piston head 53*h*, thereby driving the piston 53 downwardly relative to the housing 51. As the piston 53 begins to travel, hydraulic fluid displaced from the hydraulic chamber lower portion may flow through the passage 56*o* and into the opener line 37*o* via the hydraulic coupling 57*o*. The displaced hydraulic fluid may flow up the opener line 37*o*, through the wellhead 6, and exit the opener line into the hydraulic manifold 35*m*.

As the piston 53 travels downwardly, the piston may push the flapper 54 downwardly via the hinge pin 58*p* and the linkage spring 60*s* may push the lock sleeve 59 to follow the piston. This collective downward movement of the piston 53, flapper 54, and lock sleeve 59 may continue until the flapper has at least partially cleared the flow sleeve 52. Once at least partially free from the flow sleeve 52, the hinge spring 58*s* may begin closing the flapper 54. The collective downward movement may continue as the lock sleeve shoulder 59*m* lands onto the landing profile 55*d,e*. The landing profile opening 55*e* may prevent a seal from unintentionally being formed between the lock sleeve 59 and the lock case 51*c* which may otherwise obstruct opening of the flapper 54.

The linkage 60 may allow downward movement of the piston 53 and flapper 54 to continue free from the lock sleeve 59. The downward movement of the piston 53 and flapper 54 may continue until the hinge 58 lands onto the upper face of the lock sleeve shoulder 53*m*. Engagement of the hinge 58 with the lock sleeve 59 may prevent opening of the flapper 54 in response to pressure in the upper portion of the valve bore being greater than pressure in the lower portion of the valve bore, thereby allowing the flapper to bidirectionally isolate the upper portion of the valve bore from the lower portion of the valve bore. This bidirectional isolation may be accomplished using only the one seal interface between the flapper inner periphery and the seat 53*f*

Once the hinge 58 has landed, the technician may operate the control station 21 to shut-in the closer line 37*c* or both of the control lines 37*o,c*, thereby hydraulically locking the piston 53 in place. Drilling fluid 32 may be circulated (or continue to be circulated) in an upper portion of the wellbore 8 (above the lower flapper) to wash an upper portion of the isolation valve 50. The RCD 19 may be deactivated or disconnected from the wellhead 6. The drill string 5 may then be retrieved to the rig 1*r*.

Once circulation has been halted and/or the drill string 5 has been retrieved to the rig 1*r*, pressure in the inner casing string 11 acting on an upper face of the flapper 54 may be reduced relative to pressure in the inner casing string acting on a lower face of the flapper, thereby creating a net upward force on the flapper which is transferred to the piston 53. The upward force may be resisted by fluid pressure generated by the incompressible hydraulic fluid in the closer line 37*c*. The MCU 21*m* may be programmed with a correlation between the calculated delta pressure and the pressure differential 64*u,b* across the flapper 54. The MCU 21*m* may then convert the delta pressure to a pressure differential across the flapper 54 using the correlation. The MCU 21*m* may then output the converted pressure differential to the gauge 21*g* for monitoring by the technician.

The correlation may be determined theoretically using parameters, such as geometry of the flapper 54, geometry of the seat 53*f*, and material properties thereof, to construct a computer model, such as a finite element and/or finite difference model, of the isolation valve 50 and then a simulation may be performed using the model to derive a formula. The model may or may not be empirically adjusted.

The control station 21 may further include an alarm (not shown) operable by the MCU 21*m* for alerting the technician, such as a visual and/or audible alarm. The technician may enter one or more alarm set points into the control station 21 and the MCU 21*m* may alert the technician should the converted pressure differential violate one of the set points. A maximum set point may be a design pressure of the flapper 54.

If total depth has not been reached, the drill bit 33*b* may be replaced and the drill string 5 may be redeployed into the wellbore 8. Due to the bidirectional isolation by the valve 50, the drill string 5 may be tripped without concern of momentarily opening the flapper 54 by generating excessive surge pressure. Pressure in the upper portion of the wellbore 8 may be equalized with pressure in the lower portion of the wellbore 8 and equalization may be confirmed using the gauge 21*g*. The technician may then operate the control station 21 to supply pressurized hydraulic fluid to the opener line 37*o* while relieving the closer line 37*c*, thereby opening the isolation valve 50. Drilling may then resume. In this manner, the lower formation 22*b* may remain live during tripping due to isolation from the upper portion of the wellbore by the closed flapper 54, thereby obviating the need to kill the lower formation 22*b*.

Once drilling has reached total depth, the drill string 5 may be retrieved to the drilling rig 1*r* as discussed above. A liner string (not shown) may then be deployed into the wellbore 8 using a work string (not shown). The liner string and workstring may be deployed into the live wellbore 8 using the isolation valve 50, as discussed above for the drill string 5. Once deployed, the liner string may be set in the wellbore 8 using the workstring. The work string may then be retrieved from the wellbore 8 using the isolation valve 50 as discussed above for the drill string 5. The PCA 1*p* may then be removed from the wellhead 6. A production tubing string (not shown) may be deployed into the wellbore 8 and a production tree (not shown) may then be installed on the wellhead 6. Hydrocarbons (not shown) produced from the lower formation 22*b* may enter a bore of the liner, travel through the liner bore, and enter a bore of the production tubing for transport to the surface 9.

Alternatively, the piston sleeve knuckles 58*n* and flapper seat 53*f* may be formed in a separate member (see cap 91) connected to a bottom of the piston sleeve 53*s*, such as fastened by threaded couplings and/or fasteners. Alternatively, the flapper undercut may be omitted. Alternatively, the lock sleeve 59 may be omitted and the landing profile 55*d,e* of the housing 51 may serve as the abutment.

Figure 5A:
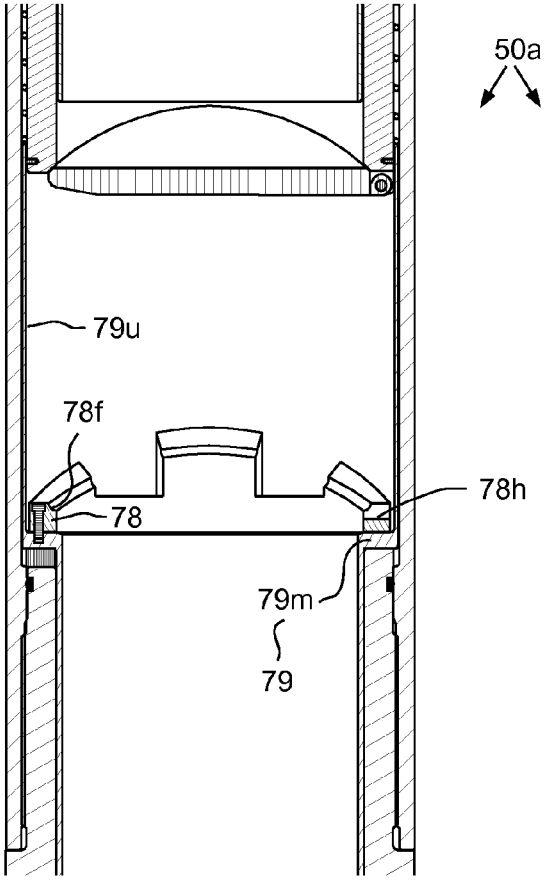
FIGS. 5A-5C illustrate a modified isolation valve having an abutment for peripheral support of the flapper, according to another embodiment of the present disclosure.
Figure 5B:
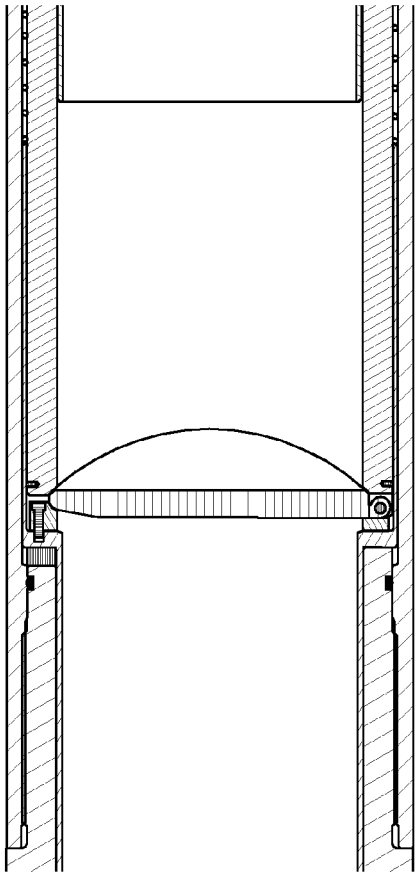
Figure 5C:
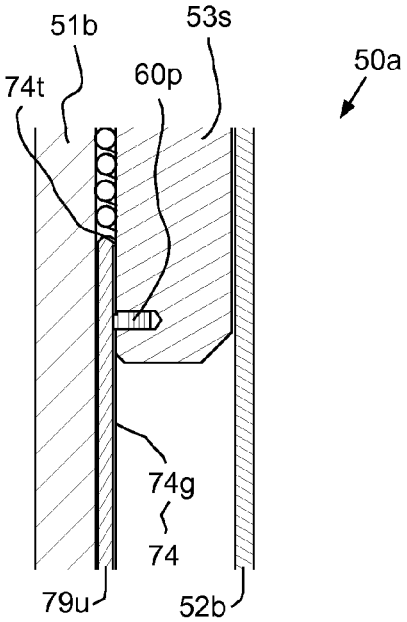

FIGS. 5A-5C illustrate a modified isolation valve 50*a* having an abutment 78 for peripheral support of the flapper 54, according to another embodiment of the present disclosure. The isolation valve 50*a* may include the housing 51, the flow sleeve 52, the piston 53, the flapper 54, the hinge 58, a linear guide 74, a lock sleeve 79, and the abutment 78. The lock sleeve 79 may be identical to the lock sleeve 59 except for having a part of the linear guide 74 and having a socket formed in an upper face of the shoulder 79*m* for connection to the abutment 78. The linear guide 74 may include a profile, such as a slot 74*g*, formed in an inner surface of the lock sleeve upper portion 79*u*, a follower, such as the pin 60*p*, and a stop 74*t* formed at upper end of the lock sleeve upper portion 70*u*. Extension of the pin 60*p* into the slot 74*g* may torsionally connect the lock sleeve 70 and the piston 53 while allowing limited longitudinal movement therebetween.

The abutment 78 may be a ring connected to the lock sleeve 79, such as by having a passage receiving a fastener engaged with the shoulder socket. The abutment 78 may have a flapper support 78*f* formed in an upper face thereof for receiving an outer periphery of the flapper 54 and a hinge pocket 78*h* formed in the upper face for receiving the hinge 60. The flapper support 78*f* may have a curved shape (FIG. 5A) complementary to the flapper curvature. An upper portion of the abutment 78 may have one or more notches formed therein to prevent a seal from unintentionally being formed between the abutment and the flapper 54 which may otherwise obstruct opening of the flapper 54. Outer peripheral support of the flapper 54 may increase the pressure capability of the valve 50*a* against a downward pressure differential (pressure in upper portion of the wellbore greater than pressure in a lower portion of the wellbore).

Alternatively, the abutment notches may be omitted such that the (modified) abutment may serve as a backseat for sealing engagement with the flapper 54. Alternatively, the lock sleeve 79 may be omitted and the abutment 78 may instead be connected to the lock case 51*c*.

Figure 6C:
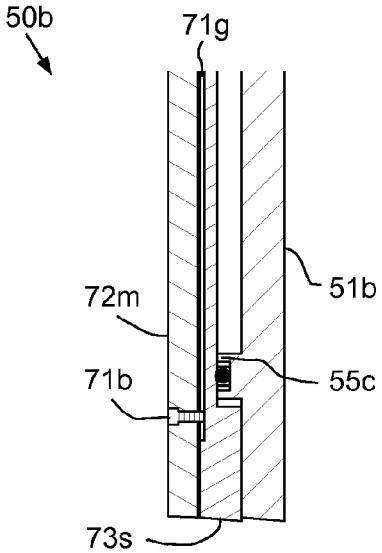
FIGS. 6A-6C illustrate a modified isolation valve having a tapered flow sleeve to resist opening of the valve, according to another embodiment of the present disclosure.
Figure 6A:
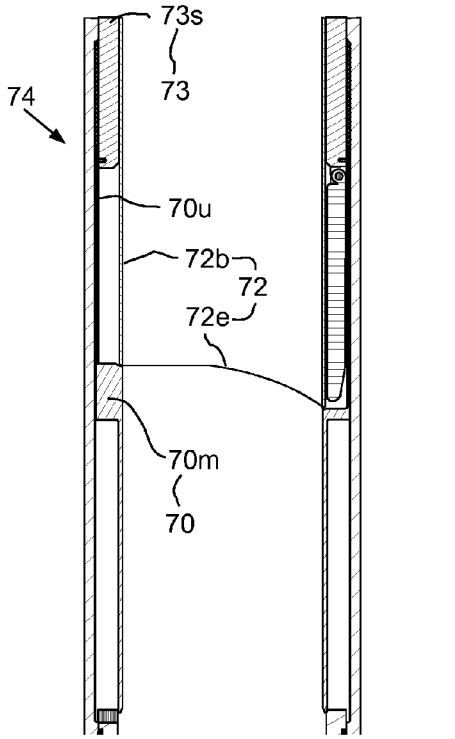
Figure 6B:
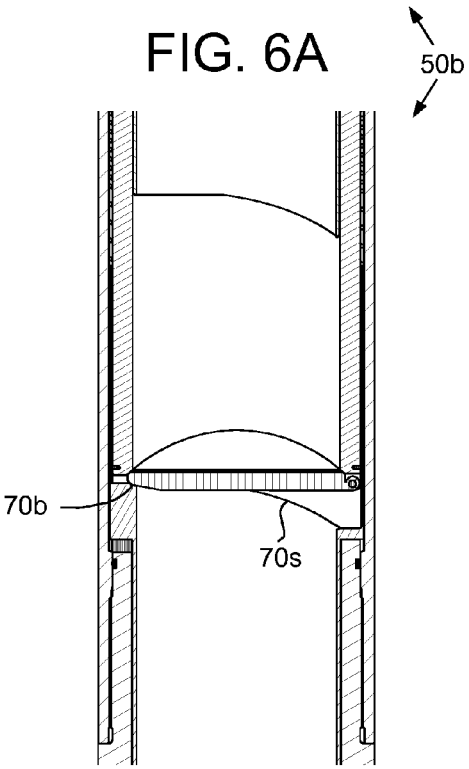

FIGS. 6A-6C illustrate a modified isolation valve 50*b* having a tapered flow sleeve 72 to resist opening of the valve, according to another embodiment of the present disclosure. The isolation valve 50*b* may include the housing 51, the flow sleeve 72, a piston 73, the linear guide 74, a second linear guide 71*b,g*, the flapper 54, the hinge 60, and an abutment 70*b*. The flow sleeve 72 may be identical to the flow sleeve 52 except for having a profile, such as a taper 72*e*, formed in a bottom of the lower portion 72*b* and having part of the second linear guide 71*b,g*. The piston 73 may be identical to the piston 53 except for having part of the second linear guide 71*b,g*. The lock sleeve 70 may be identical to the lock sleeve 79 except for having a modified shoulder portion 70*m*. The shoulder portion 70*m* may have a taper 70*s* and the abutment 70*b* formed in an upper face thereof for receiving the flapper 54. The second linear guide 71*b,g* may include a profile, such as a slot 71*g*, formed in an inner surface of the piston sleeve 73*s*, and a follower, such as a threaded fastener 71*b*, having a shaft portion extending through a socket formed through a wall of the flow sleeve mid portion 72*m*. Extension of the fastener shaft into the slot

71*g* may torsionally connect the flow sleeve 72 and the piston 73 while allowing limited longitudinal movement therebetween.

The tapered flow sleeve 72 may serve as a safeguard against unintentional opening of the valve 50*b* should the control lines 37*o,c* fail. The tapered flow sleeve 72 may be oriented such that the flapper 54 contacts the flow sleeve at a location adjacent the hinge 58, thereby reducing a lever length of an opening force exerted by the flow sleeve onto the flapper. The linear guides 71*b,g*, 74 may ensure that alignment of the flow sleeve 72, flapper 54, and lock sleeve 59 is maintained. The lock sleeve shoulder taper 70*s* may be complementary to the flow sleeve taper 72*e* for adjacent positioning when the valve 50*b* is in the open position. A portion of the flapper 54 distal from the hinge 58 may seat against the abutment 70*b* for bidirectional support of the flapper 54.

Alternatively, the abutment 70*b* may be a separate piece connected to the lock sleeve 72 and having the taper 72*e* formed in an upper portion thereof.

Figure 6D:
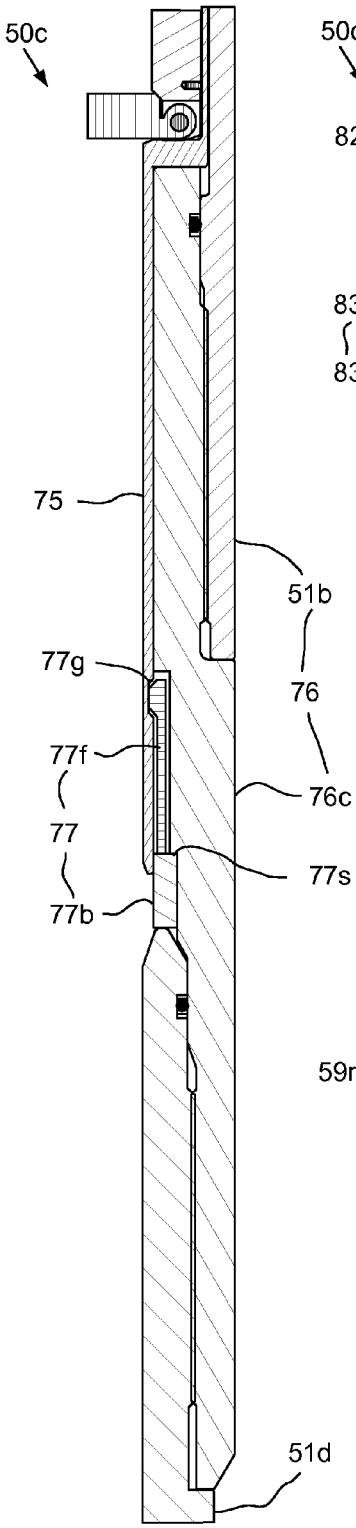
FIG. 6D illustrates a modified isolation valve having a latch for restraining the valve in the closed position, according to another embodiment of the present disclosure.

FIG. 6D illustrates a modified isolation valve 50*c* having a latch 77 for restraining the valve in the closed position, according to another embodiment of the present disclosure. The isolation valve 50*c* may include a tubular housing 76, the flow sleeve 52, the piston 53, the flapper 54, the hinge 58, the abutment shoulder 59*m*, the linkage 60, and the latch 77. The housing 76 may be identical to the housing 51 except for the replacement of lock case 76*c* for lock case 51*c*. The lock case 76*c* may be identical to the lock case 51*c* except for the inclusion of a recess having a shoulder 77*s* for receiving a collet 77*b,f*. The lock sleeve 75 may be identical to the lock sleeve 59 except for the inclusion of a latch profile, such as groove 77*g*.

The latch 77 may include the collet 77*b,f*, the groove 77*g*, and the recess formed in the lock case 71*c*. The collet 77*b,f* may be connected to the housing, such as by entrapment between a top of the lower adapter 51*d* and the recess shoulder 77*s*. The collet 77*b,f* may include a base ring 77*b* and a plurality (only one shown) of split fingers 77*f* extending longitudinally from the base. The fingers 77*f* may have lugs formed at an end distal from the base 77*b*. The fingers 77*f* may be cantilevered from the base 77*b* and have a stiffness biasing the fingers toward an engaged position (shown). As the valve 50*c* is being closed the finger lugs may snap into the groove 77*g*, thereby longitudinally fastening the lock sleeve 75 to the housing 76. The latch 73 may serve as a safeguard against unintentional opening of the valve 50*c* should the control lines 37*o,c* fail. The latch 73 may include sufficient play so as to accommodate determination of the differential pressure across the flapper 54 by monitoring pressure in the closer line 37*c*, discussed above.

Alternatively, any of the other isolation valves 50*b,d-g* may be modified to include the latch 77. Alternatively, the piston sleeve knuckles 58*n* and flapper seat 53*f* may be formed in a separate member (see cap 91) connected to a bottom of the piston sleeve 53*s*, such as fastened by threaded couplings and/or fasteners. Alternatively, the flapper undercut may be omitted.

Figure 6E:
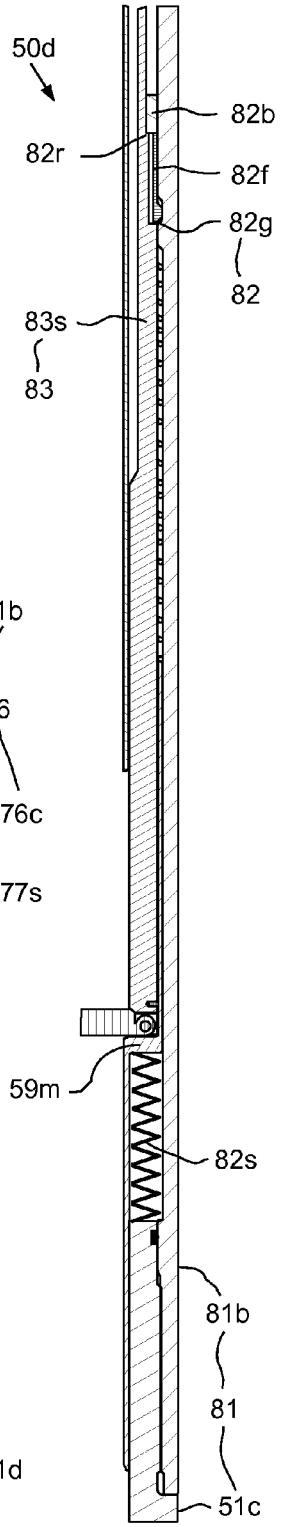
FIG. 6E illustrates another modified isolation valve having a latch for restraining the valve in the closed position, according to another embodiment of the present disclosure.

FIG. 6E illustrates another modified isolation valve 50*d* having a latch 82 for restraining the valve in the closed position, according to another embodiment of the present disclosure. The isolation valve 50*d* may include a tubular housing 81, the flow sleeve 52, a piston 83, the flapper 54, the hinge 58, the abutment shoulder 59*m*, the linkage 60, the lock sleeve 59, and the latch 82. The housing 81 may be identical to the housing 51 except for the replacement of body 81*b* for body 51*b*. The body 81 b may be identical to the body 51*b* except for the inclusion of a latch profile, such as groove 82*g*. The piston 83 may be identical to the piston 53 except for the sleeve 83*s* having a shouldered recess 82*r* for receiving a collet 82*b,f*.

The latch 82 may include the collet 82*b,f*, the groove 82*g*, the shouldered recess 82*r*, and a latch spring 82*s*. The collet 82*b,f* may include a base ring 82*b* and a plurality (only one shown) of split fingers 82*f* extending longitudinally from the base. The collet 82*b,f* may be connected to the piston 83, such as by fastening of the base 82*b* to the piston sleeve 83*s*. The fingers 82*f* may have lugs formed at an end distal from the base 82*b*. The fingers 82*f* may be cantilevered from the base 82*b* and have a stiffness biasing the fingers toward an engaged position (shown). The latch spring 82*s* may be disposed in a chamber formed between the lock sleeve 59 and the lock case 51*c*. The latch spring 82*s* may be compact, such as a Belleville spring, such that the spring only engages the lock sleeve shoulder 59*m* when the lock sleeve shoulder is adjacent to the profile 55*d,e*. As the valve 50*d* is being closed and after closing of the flapper 54, the lock sleeve shoulder 59*m* may engage and compress the latch spring 82*s*. The finger lugs may then snap into the groove 82*g*, thereby longitudinally fastening the piston 82 to the housing 81. The finger stiffness may generate a latching force substantially greater than a separation force generated by compression of the latch spring, thereby preloading the latch 82. The latch 82 may serve as a safeguard against unintentional opening of the valve 50*d* should the control lines 37*o,c* fail. The latch 82 may include sufficient play so as to accommodate determination of the differential pressure across the flapper 54 by monitoring pressure in the closer line 37*c*, discussed above.

Alternatively, the lock sleeve 70 may be omitted and the landing profile 55*d,e* of the housing 51 may serve as the abutment. Alternatively, any of the other isolation valves 50*b,c,e-g* may be modified to include the latch 82. Alternatively, the piston sleeve knuckles 58*n* and flapper seat 53*f* may be formed in a separate member (see cap 91) connected to a bottom of the piston sleeve 53*s*, such as fastened by threaded couplings and/or fasteners. Alternatively, the flapper undercut may be omitted.

Figure 7A:
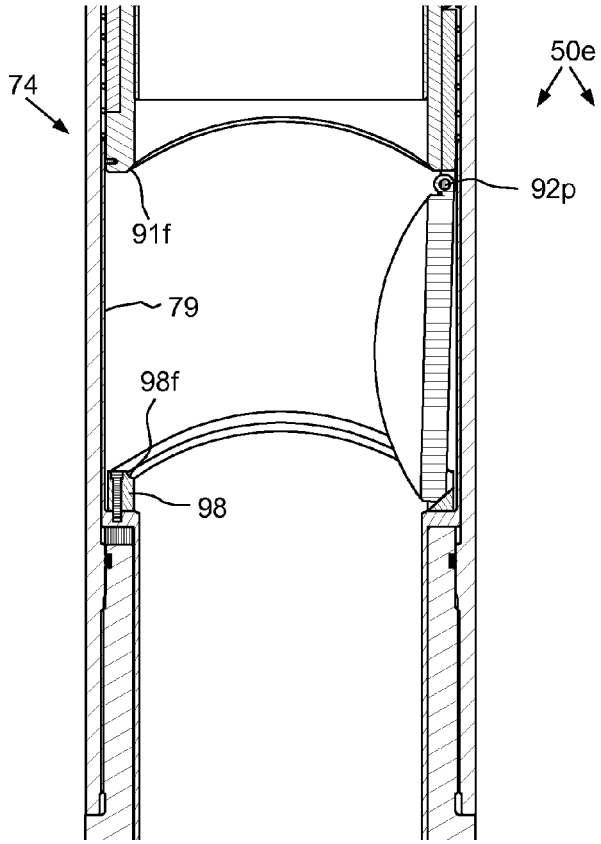
FIGS. 7A and 7B illustrate another modified isolation valve having an articulating flapper joint, according to another embodiment of the present disclosure.
Figure 7B:
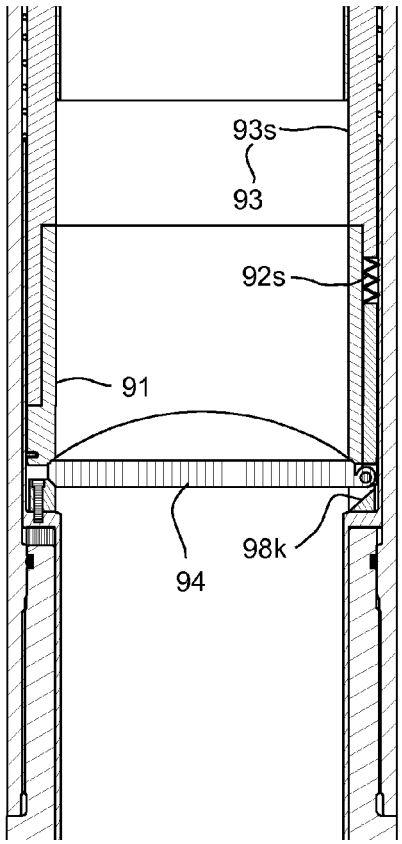

FIGS. 7A and 7B illustrate another modified isolation valve 50*e* having an articulating flapper joint, according to another embodiment of the present disclosure. The isolation valve 50*e* may include the housing 51, the flow sleeve 52, a piston 93, a flapper 94, the linear guide 74, the lock sleeve 79, the articulating joint, such as a slide hinge 92, and an abutment 98. The piston 93 may be longitudinally movable relative to the housing 51. The piston 93 may include the head 53*h* and a sleeve 93*s* longitudinally connected to the head, such as fastened with threaded couplings and/or fasteners.

The abutment 98 may be a ring connected to the lock sleeve 79, such as by having a passage receiving a fastener engaged with the shoulder socket. The abutment 98 may have a flapper support 98*f* formed in an upper face thereof for receiving an outer periphery of the flapper 94 and a kickoff pocket 98*k* formed in the upper face for assisting the slide hinge in closing of the flapper 94. The flapper support 98*f* may have a curved shape (FIG. 7A) complementary to the flapper curvature. The kickoff pocket 98*k* may form a guide profile to receive a lower end of the flapper 94 and radially push the flapper lower end into the valve bore (FIG. 7A).

Figure 7C:
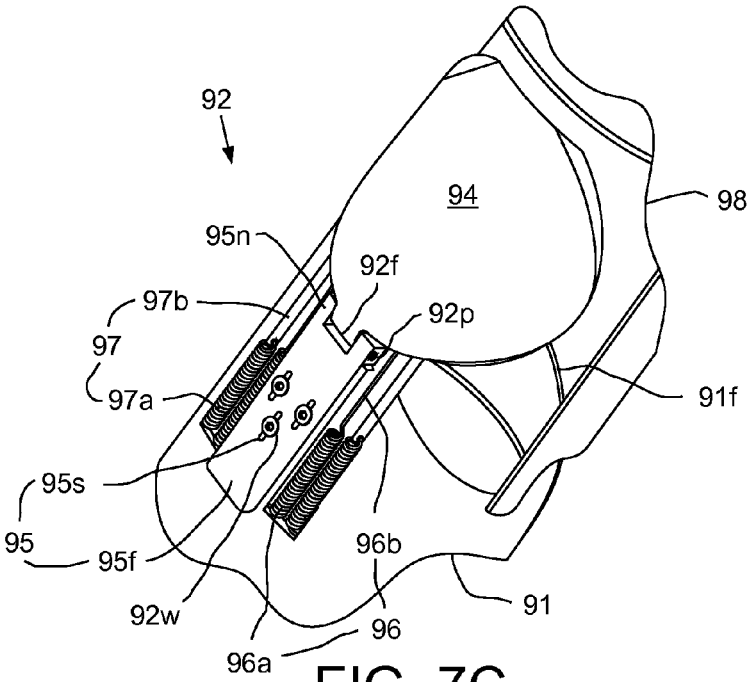
FIG. 7C illustrates the flapper joint of the modified valve.

FIG. 7C illustrates the slide hinge 92 of the modified valve 50*e*. The slide hinge 92 may link the flapper 94 to the piston 93 such that the flapper may be carried by the piston while being able to articulate (pivot and slide) relative to the piston between the open (shown) and closed (FIG. 7B) positions. The slide hinge 92 may include a cap 91, a slider 95, one or more flapper springs 96, 97 (pair of each shown), and a slider spring 92*s*. The piston sleeve 93*s* may have a recess formed in an outer surface thereof adjacent the bottom of the piston sleeve for receiving the slider 95 and slider spring 92*s*. The slider spring 92*s* may be disposed between a top of the slider 95 and a top of the sleeve recess, thereby biasing the slider away from the piston sleeve 93*s*.

The cap 91 may have a seat 91*f* formed at a bottom thereof. An inner periphery of the flapper 94 may engage the seat 91*f* in the closed position, thereby isolating an upper portion of the valve bore from a lower portion of the valve bore. The slider 95 may have a leaf portion 95*f* and one or more knuckle portions 95*n*. The flapper 94 may be pivotally connected to the slider 95, such as by a knuckle 92*f* formed at an upper end of the flapper 94 and a fastener, such as hinge pin 92*p*, extending through holes of the knuckles 92*f*, 95*n*. The cap 91 may be longitudinally and torsionally connected to a bottom of the piston sleeve 93*s*, such as fastened with threaded couplings and/or fasteners. The slider 95 may be linked to the cap 91, such as by one or more (three shown) fasteners 92*w* extending through respective slots 95*s* formed through the slider and being received by respective sockets (not shown) formed in the cap. The fastener-slot linkage 92*w*, 95*s* may torsionally connect the slider 95 and the cap 91 and longitudinally connect the slider and cap subject to limited longitudinal freedom afforded by the slot.

The flapper 94 may be biased toward the closed position by the flapper springs 96, 97. The springs 96, 97 may be linear and may each include a respective main portion 96*a*, 97*a* and an extension 96*b*, 97*b*. The cap 91 may have slots formed therethrough for receiving the main portions 96*b*, 97*b*. An upper end of the main portions 96*b*, 97*b* may be connected to the cap 91 at a top of the slots. The cap 91 may also have a guide path formed in an outer surface thereof for passage of the extensions 96*b*, 97*b* to the flapper 94. Lower ends of the extensions 96*b*, 97*b* may be connected to an inner face of the flapper 94. The flapper springs 96, 97 may exert tensile force on the flapper inner face, thereby pulling the flapper 94 toward the seat 91*f* about the hinge pin 92*p*. The kickoff profile 92*p* may assist the flapper springs 96, 97 in closing the flapper 94 due to the reduced lever arm of the spring tension when the flapper is in the open position.

Alternatively, the flapper support 98*f* may be omitted and the kickoff profile 98*k* may instead be formed around the abutment 98 and additionally serve as the flapper support. Alternatively, the lock sleeve 79 may be omitted and the abutment 98 may instead be connected to the lock case 51*c*. Alternatively, the flapper 94 may be undercut. Alternatively, a polymer seal ring may be disposed in a groove formed in the flapper seat 91*f* (see FIG. 12 of U.S. Pat. No. 8,261,836, which is herein incorporated by reference in its entirety) such that the interface between the flapper inner periphery and the seat 91*f* is a hybrid polymer and metal to metal seal. Alternatively, the seal ring may be disposed in the flapper inner periphery.

Figures 8A, 8B, 8C:
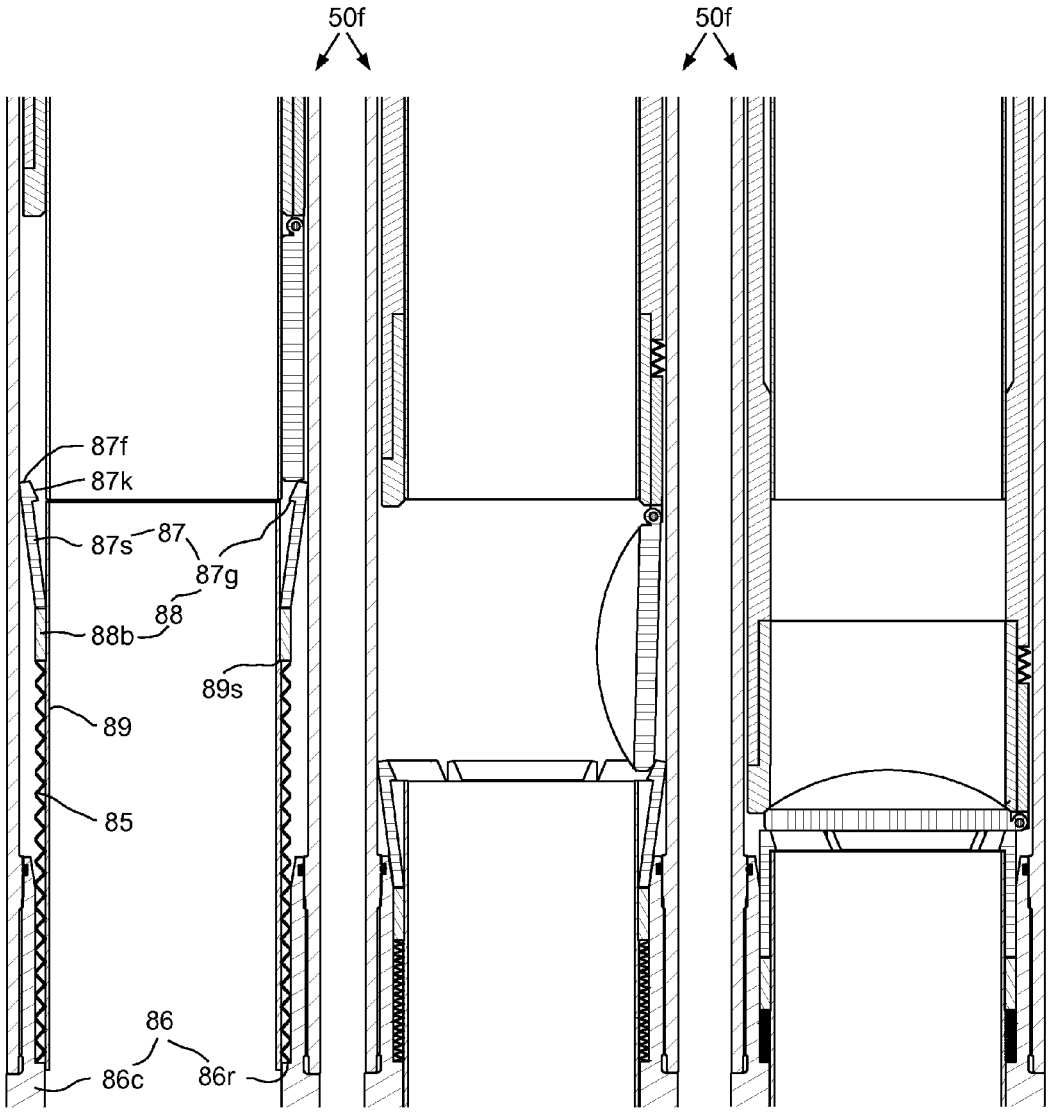
FIGS. 8A-8C illustrate another modified isolation valve having a combined abutment and kickoff profile, according to another embodiment of the present disclosure.

FIGS. 8A-8C illustrate another modified isolation valve 50*f* having a combined abutment 87*f* and kickoff profile 87*k*, according to another embodiment of the present disclosure. The isolation valve 50*f* may include a tubular housing 86, the flow sleeve 52, the piston 93, the flapper 94, a chamber sleeve 89, the slide hinge 92, the kickoff profile 87*k*, and the abutment 87*f*. The housing 86 may be identical to the housing 51 except for the replacement of lock case 86*c* for lock case 51*c* and modified lower adapter (not shown) for lower adapter 51*d*. The lock case 86*c* may be identical to the lock case 51*c* except for the inclusion of a guide profile 86*r*. The chamber sleeve 89 may be may have a shouldered recess 82*r* for receiving a collet 88.

The collet 88 may include a base ring 88*b* and a plurality of split fingers 87 extending longitudinally from the base. The collet 88 may be connected to the chamber sleeve 89, such as by fastening of the base 82*b* thereto. The fingers 87 may each have a shank portion 87*s* and a lug 87*f,k,g*, formed at an end of the shank portion 87*s* distal from the base 88*b*. The shanks 87*s* may each be cantilevered from the base 88*b* and have a stiffness biasing the lug 87*f,k,g* toward an expanded position (FIGS. 8A and 8B). The abutment 87*f* may be formed in a top of the lugs 87*f,k,s*, the kickoff profile 87*k* may be formed in an inner surface of the lugs, and a sleeve receiver 87*g* may also be formed in an inner surface of the lugs. A sleeve spring 85 may be disposed in the guide profile 86*r* between the lock case 86*c* and the base ring 88*b*, thereby biasing the chamber sleeve 89 toward the flow sleeve 52. The sleeve spring 85 may be compact, such as a Belleville spring, and be capable of compressing to a solid position (FIG. 8C). As the valve 50*f* is being closed, the flapper 94 may push the collet 88 and chamber sleeve 89 downward. Once the flapper 94 clears the flow sleeve 52, the kickoff profile 87*k* may radially push the flapper lower end into the valve bore. Once the flapper 94 has closed, the knuckles 92*f*, 95*n* may continue to push the collet 88 and chamber sleeve 89 until the collet is forced into the guide profile 86*r*, thereby retracting the collet into a compressed position (FIG. 8C) and engaging the abutment 87*f* with a central portion of the flapper outer surface.

Alternatively, the flapper 94 may be undercut. Alternatively, the interface between the flapper inner periphery and the seat 91*f* is a hybrid polymer and metal to metal seal. Alternatively, the seal ring may be disposed in the flapper inner periphery. Alternatively, collet fingers 87 may have a curved shape complementary to the flapper curvature.

FIGS. 9A-9D illustrate operation of an offshore drilling system 101 in a tripping mode, according to another embodiment of the present disclosure. The offshore drilling system 101 may include a mobile offshore drilling unit (MODU) 101*m*, such as a semi-submersible, the drilling rig 1*r*, a fluid handling system 101*f*, a fluid transport system 101*t*, and a pressure control assembly (PCA) 101*p*.

The MODU 101*m* may carry the drilling rig 1*r* and the fluid handling system 101*f* aboard and may include a moon pool, through which drilling operations are conducted. The semi-submersible MODU 101*m* may include a lower barge hull which floats below a surface (aka waterline) 102*s* of sea 102 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 101*h*. The MODU 101*m* may further have a dynamic positioning system (DPS) (not shown) or be moored for maintaining the moon pool in position over a subsea wellhead 110. The drilling rig 1*r* may further include a drill string compensator (not shown) to account for heave of the MODU 101*m*. The drill string compensator may be disposed between the traveling block 14 and the top drive 13 (aka hook mounted) or between the crown block 16 and the derrick 2 (aka top mounted).

Alternatively, the MODU may be a drill ship. Alternatively, a fixed offshore drilling unit or a non-mobile floating offshore drilling unit may be used instead of the MODU.

The fluid transport system 101*t* may include a drill string 105, an upper marine riser package (UMRP) 120, a marine riser 125, a booster line 127, and a choke line 128. The drill string 105 may include a BHA and the drill pipe 5*p*. The BHA may be connected to the drill pipe 5*p*, such as by threaded couplings, and include the drill bit 33*b*, the drill collars 33*c*, a shifting tool 150, and a ball catcher (not shown).

The PCA 101*p* may be connected to the wellhead 110 located adjacent to a floor 102*f* of the sea 102. A conductor string 107 may be driven into the seafloor 102*f*. The conductor string 107 may include a housing and joints of conductor pipe connected together, such as by threaded couplings. Once the conductor string 107 has been set, a subsea wellbore 108 may be drilled into the seafloor 102*f* and a casing string 111 may be deployed into the wellbore. The wellhead housing may land in the conductor housing during deployment of the casing string 111. The casing string 111 may be cemented 112 into the wellbore 108. The casing string 111 may extend to a depth adjacent a bottom of the upper formation 22*u*.

The casing string 111 may include a wellhead housing, joints of casing connected together, such as by threaded couplings, and an isolation assembly 200*o,c*, 50*g* connected to the casing joints, such as by threaded couplings. The isolation assembly 200*o,c*, 50*g* may include one or more power subs, such as an opener 200*o* and a closer 200*c*, and an isolation valve 50*g*. The isolation assembly 200*o,c*, 50*g* may further include a spacer sub (not shown) disposed between the closer 200*c* and the isolation valve 50*g* and/or between the opener 200*o* and the closer. The power subs 200*o,c* may be hydraulically connected to the isolation valve 50*g* in a three-way configuration such that operation of one of the power subs 200*o,c* will operate the isolation valve 50*g* between the open and closed positions and alternate the other power sub 200*o,c*. This three way configuration may allow each power sub 200*o,c* to be operated in only one rotational direction and each power sub to only open or close the isolation valve 50*g*. Respective hydraulic couplings (not shown) of each power sub 200*o,c* and the hydraulic couplings 57*o,c* of the isolation valve 50*g* may be connected by respective conduits 245*a-c*, such as tubing.

The PCA 101*p* may include a wellhead adapter 40*b*, one or more flow crosses 41*u,m,b*, one or more blow out preventers (BOPs) 42*a,u,b*, a lower marine riser package (LMRP), one or more accumulators 44, and a receiver 46. The LMRP may include a control pod 116, a flex joint 43, and a connector 40*u*. The wellhead adapter 40*b*, flow crosses 41*u,m,b*, BOPs 42*a,u,b*, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 110.

Each of the connector 40*u* and wellhead adapter 40*b* may include one or more fasteners, such as dogs, for fastening the LMRP to the BOPs 42*a,u,b* and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 116 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 125 and connect the riser to the PCA 101*p*. The control pod 116 may be in electric, hydraulic, and/or optical communication with the PLC 36 onboard the MODU 101*m* via an umbilical 117. The control pod 116 may include one or more control valves (not shown) in communication with the BOPs 42*a,u,b* for operation thereof. Each control valve may include an electric or hydraulic actuator in communication with the umbilical 117. The umbilical 117 may include one or more hydraulic or electric control conduit/cables for the actuators. The accumulators 44 may store pressurized hydraulic fluid for operating the BOPs 42*a,u,b*. Additionally, the accumulators 44 may be used for operating one or more of the other components of the PCA 101*p*. The umbilical 117 may further include hydraulic, electric, and/or optic control conduit/cables for operating various functions of the PCA 101*p*. The PLC 36 may operate the PCA 101*p* via the umbilical 117 and the control pod 116.

A lower end of the booster line 127 may be connected to a branch of the flow cross 41*u* by a shutoff valve 45*a*. A booster manifold may also connect to the booster line lower end and have a prong connected to a respective branch of each flow cross 41*m,b*. Shutoff valves 45*b,c* may be disposed in respective prongs of the booster manifold. Alternatively, a separate kill line (not shown) may be connected to the branches of the flow crosses 41*m,b* instead of the booster manifold. An upper end of the booster line 127 may be connected to an outlet of a booster pump (not shown). A lower end of the choke line 128 may have prongs connected to respective second branches of the flow crosses 41*m,b*. Shutoff valves 45*d,e* may be disposed in respective prongs of the choke line lower end.

A pressure sensor 47*a* may be connected to a second branch of the upper flow cross 41*u*. Pressure sensors 47*b,c* may be connected to the choke line prongs between respective shutoff valves 45*d,e* and respective flow cross second branches. Each pressure sensor 47*a-c* may be in data communication with the control pod 116. The lines 127, 128 and umbilical 117 may extend between the MODU 1*m* and the PCA 1*p* by being fastened to brackets disposed along the riser 125. Each line 127, 128 may be a flow conduit, such as coiled tubing. Each shutoff valve 45*a-e* may be automated and have a hydraulic actuator (not shown) operable by the control pod 116 via fluid communication with a respective umbilical conduit or the LMRP accumulators 44. Alternatively, the valve actuators may be electrical or pneumatic.

The riser 125 may extend from the PCA 101*p* to the MODU 101*m* and may connect to the MODU via the UMRP 120. The UMRP 120 may include a diverter 121, a flex joint 122, a slip (aka telescopic) joint 123, a tensioner 124, and an RCD 126. A lower end of the RCD 126 may be connected to an upper end of the riser 125, such as by a flanged connection. The slip joint 123 may include an outer barrel connected to an upper end of the RCD 126, such as by a flanged connection, and an inner barrel connected to the flex joint 122, such as by a flanged connection. The outer barrel may also be connected to the tensioner 124, such as by a tensioner ring (not shown).

The flex joint 122 may also connect to the diverter 121, such as by a flanged connection. The diverter 121 may also be connected to the rig floor 3, such as by a bracket. The slip joint 123 may be operable to extend and retract in response to heave of the MODU 101*m* relative to the riser 125 while the tensioner 124 may reel wire rope in response to the heave, thereby supporting the riser 125 from the MODU 101*m* while accommodating the heave. The flex joints 123, 43 may accommodate respective horizontal and/or rotational (aka pitch and roll) movement of the MODU 101 m relative to the riser 125 and the riser relative to the PCA 101*p*. The riser 125 may have one or more buoyancy modules (not shown) disposed therealong to reduce load on the tensioner 124.

The RCD 126 may include a housing, a piston, a latch, and a bearing assembly. The housing may be tubular and have one or more sections connected together, such as by flanged connections. The bearing assembly may include a bearing pack, a housing seal assembly, one or more strippers, and a catch sleeve. The bearing assembly may be selectively longitudinally and torsionally connected to the housing by engagement of the latch with the catch sleeve. The housing may have hydraulic ports in fluid communication with the piston and an interface of the RCD 126. The bearing pack may support the strippers from the sleeve such that the strippers may rotate relative to the housing (and the sleeve). The bearing pack may include one or more radial bearings, one or more thrust bearings, and a self contained lubricant system. The bearing pack may be disposed between the strippers and be housed in and connected to the catch sleeve, such as by threaded couplings and/or fasteners.

Each stripper may include a gland or retainer and a seal. Each stripper seal may be directional and oriented to seal against the drill pipe 5*p* in response to higher pressure in the riser 125 than the UMRP 120. Each stripper seal may have a conical shape for fluid pressure to act against a respective tapered surface thereof, thereby generating sealing pressure against the drill pipe 5*p*. Each stripper seal may have an inner diameter slightly less than a pipe diameter of the drill pipe 5*p* to form an interference fit therebetween. Each stripper seal may be flexible enough to accommodate and seal against threaded couplings of the drill pipe 5*p* having a larger tool joint diameter. The drill pipe 5*p* may be received through a bore of the bearing assembly so that the stripper seals may engage the drill pipe. The stripper seals may provide a desired barrier in the riser 125 either when the drill pipe 5*p* is stationary or rotating. The RCD 126 may be submerged adjacent the waterline 102*s*. The RCD interface may be in fluid communication with an auxiliary hydraulic power unit (HPU) (not shown) of the PLC 36 via an auxiliary umbilical 118.

Alternatively, an active seal RCD may be used. Alternatively, the RCD may be located above the waterline and/or along the UMRP at any other location besides a lower end thereof. Alternatively, the RCD may be assembled as part of the riser at any location therealong or as part of the PCA. Alternatively, the riser 125 and UMRP 120 may be omitted. Alternatively, the auxiliary umbilical may be in communication with a control console (not shown) instead of the PLC 36.

The fluid handling system 101*f* may include a return line 129, the mud pump 24, the shale shaker 33, the flow meters 27*d,r*, the pressure sensors 28*d,r*, the choke 20, the supply line 30*p,h*, the degassing spool (not shown), a drilling fluid reservoir, such as a tank 25, a tag reader 132, and one or more launchers, such as tag launcher 131*t* and ball launcher 131*b*. A lower end of the return line 129 may be connected to an outlet of the RCD 126 and an upper end of the return line may be connected to an inlet of the shaker 26. The returns pressure sensor 28*r*, choke 20, returns flow meter 27*r*, and tag reader 132 may be assembled as part of the return line 129. A transfer line 130 may connect an outlet of the tank 25 to an inlet of the mud pump 24.

Each launcher 131*b,t* may be assembled as part of the drilling fluid supply line 30*p,h*. Each launcher 131*b,t* may include a housing, a plunger, and an actuator. The tag launcher 131*t* may further include a magazine (not shown) having a plurality of radio frequency identification (RFID) tags loaded therein. A chambered RFID tag 290 may be disposed in the plunger for selective release and pumping downhole to communicate with one or more sensor subs 282*u,b*. The plunger of each launcher 131*b,t* may be movable relative to the respective launcher housing between a capture position and a release position. The plunger may be moved between the positions by the actuator. The actuator may be hydraulic, such as a piston and cylinder assembly and may be in communication with the PLC HPU. Alternatively, the actuator may be electric or pneumatic.

Alternatively, the actuator may be manual, such as a handwheel. Alternatively, the tags 290 may be any other kind of wireless identification tags, such as acoustic.

Figure 9C:
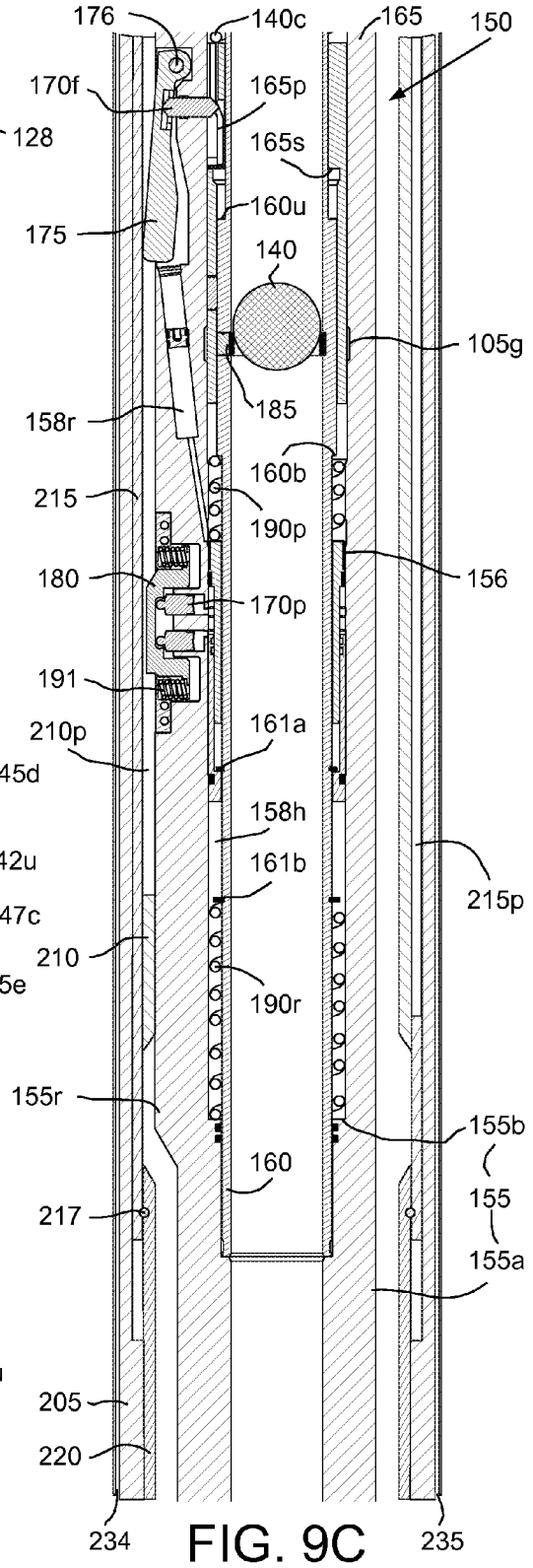
Figure 9D:
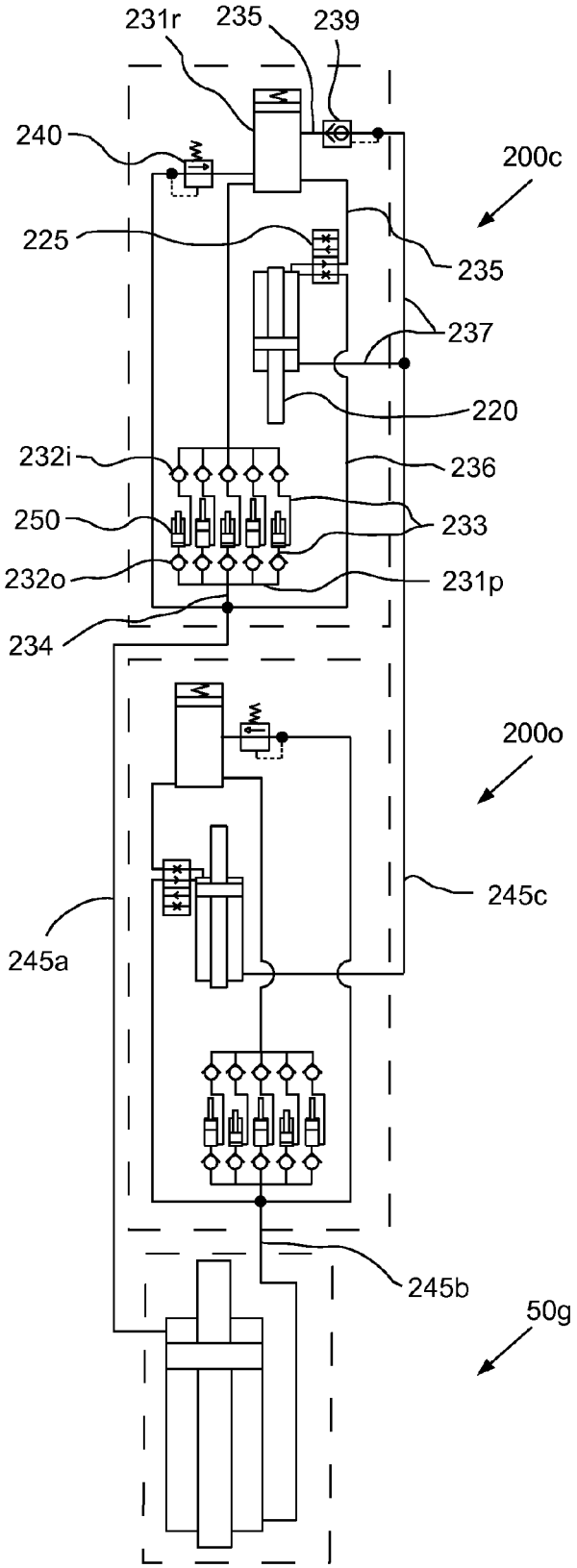

Referring specifically to FIGS. 9C and 9D, each power sub 200*o,c* may include a tubular housing 205, a tubular mandrel 210, a release sleeve 215, a release piston 220, a control valve 225, hydraulic circuit, and a pump 250. The housing 205 may have couplings (not shown) formed at each longitudinal end thereof for connection between the power subs 200*o,c*, with the spacer sub, or with other components of the casing string 111. The couplings may be threaded, such as a box and a pin. The housing 205 may have a central longitudinal bore formed therethrough. The housing 205 may include two or more sections (only one section shown) to facilitate manufacturing and assembly, each section connected together, such as fastened with threaded connections.

The mandrel 210 may be disposed within the housing 205, longitudinally connected thereto, and rotatable relative thereto. The mandrel 210 may have a profile 210*p* formed through a wall thereof for receiving a respective driver 180 and release 175 of the shifting tool 150. The mandrel profile 210*p* may be a series of slots spaced around the mandrel inner surface. The mandrel slots may have a length equal to, greater than, or substantially greater than a length of a ribbed portion 155 of the shifting tool 150 to provide an engagement tolerance and/or to compensate for heave of the drill string 105 for subsea drilling operations.

The release piston 220 may be tubular and have a shoulder (not shown) disposed in a chamber (not shown) formed in the housing 205 between an upper shoulder (not shown) of the housing and a lower shoulder (not shown) of the housing. The chamber may be defined radially between the release piston 220 and the housing 205 and longitudinally between an upper seal disposed between the housing 205 and the release piston 220 proximate the upper shoulder and a lower seal disposed between the housing and the release piston proximate the lower shoulder. A piston seal may also be disposed between the release piston shoulder and the housing 205. Hydraulic fluid may be disposed in the chamber. A second hydraulic passage 235 formed in the housing 205, may selectively provide (discussed below) fluid communication between the chamber and a hydraulic reservoir 231*r* formed in the housing.

The release piston 220 may be longitudinally connected to the release sleeve 215, such as by bearing 217, so that the release sleeve may rotate relative to the release piston. The release sleeve 215 may be operably coupled to the mandrel 210 by a cam profile (not shown) and one or more followers (not shown). The cam profile may be formed in an inner surface of the release sleeve 215 and the follower may be fastened to the mandrel 210 and extend from the mandrel outer surface into the profile or vice versa. The cam profile may repeatedly extend around the sleeve inner surface so that the cam follower continuously travels along the profile as the sleeve 215 is moved longitudinally relative to the mandrel 210 by the release piston 220.

Engagement of the cam follower with the cam profile may rotationally connect the mandrel 210 and the sleeve 215 when the cam follower is in a straight portion of the cam profile and cause limited relative rotation between the mandrel and the sleeve as the follower travels through a curved portion of the profile. The cam profile may be a V-slot. The release sleeve 215 may have a release profile 215*p* formed through a wall thereof for receiving the shifting tool release 175. The release profile 215*p* may be a series of slots spaced around the sleeve inner surface. The release slots may correspond to the mandrel slots. The release slots may be oriented relative to the cam profile so that the release slots are aligned with the mandrel slots when the cam follower is at a bottom of the V-slot and misaligned when the cam follower is at any other location of the V-slot (covering the mandrel slots with the sleeve wall).

The control valve 225 may be tubular and be disposed in the housing chamber. The control valve 225 may be longitudinally movable relative to the housing 205 between a lower position and an upper position. The control valve 225 may have an upper shoulder (not shown) and a lower shoulder (not shown) connected by a control sleeve (not shown) and a latch (not shown) extending from the lower shoulder. The control valve 225 may also have a port (not shown) formed through the control sleeve. The upper shoulder may carry a pair of seals in engagement with the housing 205. In the lower position, the seals may straddle a hydraulic port 236 formed in the housing 205 and in fluid communication with a first hydraulic passage 234 formed in the housing 205, thereby preventing fluid communication between the hydraulic passage and an upper face of the release piston shoulder.

In the lower position, the upper shoulder 225*u* may also expose another hydraulic port (not shown) formed in the housing 205 and in fluid communication with the second hydraulic passage 235. The port may provide fluid communication between the second hydraulic passage 235 and the upper face of the release piston shoulder via a passage formed between an inner surface of the upper shoulder and an outer surface of the release piston 220. In the upper position, the upper shoulder seals may straddle the hydraulic port, thereby preventing fluid communication between the second hydraulic passage 235 and the upper face of the release piston shoulder. In the upper position, the upper shoulder may also expose the hydraulic port 236, thereby providing fluid communication between the first hydraulic passage 234 and the upper face of the release piston shoulder via the ports 236.

The control valve 225 may be operated between the upper and lower positions by interaction with the release piston 220 and the housing 205. The control valve 225 may interact with the release piston 220 by one or more biasing members, such as springs (not shown) and with the housing by the latch. The upper spring may be disposed between the upper valve shoulder and the upper face of the release piston shoulder and the lower spring may be disposed between the lower face of the release piston shoulder and the lower valve shoulder. The housing 205 may have a latch profile formed adjacent the lower shoulder. The latch profile may receive the valve latch, thereby fastening the control valve 225 to the housing 205 when the control valve is in the lower position. The upper spring may bias the upper valve shoulder toward the upper housing shoulder and the lower spring may bias the lower valve shoulder toward the lower housing shoulder.

As the release piston shoulder moves longitudinally downward toward the lower shoulder, the biasing force of the upper spring may decrease while the biasing force of the lower spring increases. The latch and profile may resist movement of the control valve 225 until or almost until the release piston shoulder reaches an end of a lower stroke. Once the biasing force of the lower spring exceeds the resistance of the latch and latch profile, the control valve 225 may snap from the upper position to the lower position. Movement of the control valve 225 from the lower position to the upper position may similarly occur by snap action when the biasing force of the upper spring against the upper valve shoulder exceeds the resistance of the latch and latch profile.

The pump 250 may include one or more (five shown) pistons each disposed in a respective piston chamber formed in the housing 205. Each piston may interact with the mandrel 210 via a swash bearing (not shown). The swash bearing may include a rolling element disposed in an eccentric groove formed in an outer surface of the mandrel 210 and connected to a respective piston. Each piston chamber may be in fluid communication with a respective hydraulic conduit 233 formed in the housing 205. Each hydraulic conduit 233 may be in selective fluid communication with the reservoir 231*r* via a respective inlet check valve 232*i* and may be in selective fluid communication with a pressure chamber 231*p* via a respective outlet check valve 232*o*. The inlet check valve 232*i* may allow hydraulic fluid flow from the reservoir 231*r* to each piston chamber and prevent reverse flow therethrough and the outlet check valve 232*o* may allow hydraulic fluid flow from each piston chamber to the pressure chamber 231*p* and prevent reverse flow therethrough.

In operation, as the mandrel 210 is rotated 4*r* by the shifting tool driver 180, the eccentric angle of the swash bearing may cause reciprocation of the pump pistons. As each pump piston travels longitudinally downward relative to the chamber, the piston may draw hydraulic fluid from the reservoir 231*r* via the inlet check valve 232*i* and the conduit 233. As each pump piston reverses and travels longitudinally upward relative to the respective piston chamber, the piston may drive the hydraulic fluid into the pressure chamber 231*p* via the conduit 233 and the outlet check valve 232*o*. The pressurized hydraulic fluid may then flow along the first hydraulic passage 234 to the isolation valve 50*g* via respective hydraulic conduit 245*a,b*, thereby opening or closing the isolation valve (depending on whether the power sub is the opener 200*o* or the closer 200*c*). Alternatively, an annular piston may be used in the swash pump 250 instead of the rod pistons. Alternatively, a centrifugal or another type of positive displacement pump may be used instead of the swash pump.

Hydraulic fluid displaced by operation of the isolation valve 50*g* may be received by the first hydraulic passage 234 via the respective conduit 245*a,b*. The lower face of the release piston shoulder may receive the exhausted hydraulic fluid via a flow space formed between the lower face of the lower valve shoulder, leakage through the latch, and a flow passage formed between an inner surface of the lower valve shoulder and an outer surface of the release piston 220. Pressure exerted on the lower face of the release piston shoulder may move the release piston 220 longitudinally upward until the control valve 225 snaps into the upper position. Hydraulic fluid may be exhausted from the housing chamber to the reservoir 231*r* via the second hydraulic passage 235. When the other one of the power subs 200*o,c* is operated, hydraulic fluid exhausted from the isolation valve 50*g* may be received via the first hydraulic passage 234. As discussed above, the upper face of the release piston shoulder may be in fluid communication with the first hydraulic passage 234. Pressure exerted on the upper face of the release piston shoulder may move the release piston 220 longitudinally downward until the control valve 225 snaps into the lower position. Hydraulic fluid may be exhausted from the housing chamber to the other power sub 200*o,c* via a third hydraulic passage 237 formed in the housing 205 and hydraulic conduit 245*c*.

To account for thermal expansion of the hydraulic fluid, the lower portion of the housing chamber (below the seal of the valve sleeve and the seal of the release piston shoulder) may be in selective fluid communication with the reservoir 231*r* via the second hydraulic passage 235, a pilot-check valve 239, and the third hydraulic passage 237. The pilot-check valve 239 may allow fluid flow between the reservoir 231*r* and the housing chamber lower portion (both directions) unless pressure in the housing chamber lower portion exceeds reservoir pressure by a preset nominal pressure. Once the preset pressure is reached, the pilot-check valve 239 may operate as a conventional check valve oriented to allow flow from the reservoir 231*r* to the housing chamber lower portion and prevent reverse flow therethrough. The reservoir 231*r* may be divided into an upper portion and a lower portion by a compensator piston. The reservoir upper portion may be sealed at a nominal pressure or maintained at wellbore pressure by a vent (not shown). To prevent damage to the power sub 200*o,c* or the isolation valve 50*g* by continued rotation of the drill string 105 after the isolation valve has been opened or closed by the respective power sub 200*o,c*, the pressure chamber 231*p* may be in selective fluid communication with the reservoir 231*r* via a pressure relief valve 240. The pressure relief valve 240 may prevent fluid communication between the reservoir and the pressure chamber unless pressure in the pressure chamber exceeds pressure in the reservoir by a preset pressure.

The shifting tool 150 may include a tubular housing 155, a tubular mandrel 160, one or more releases 175, and one or more drivers 180. The housing 155 may have couplings (not shown) formed at each longitudinal end thereof for connection with other components of the drill string 110. The couplings may be threaded, such as a box and a pin. The housing 155 may have a central longitudinal bore formed therethrough for conducting drilling fluid. The housing 155 may include two or more sections 155*a,c*. The housing section 155*c* may be fastened to the housing section 155*a*. The housing 155 may have a groove 155*g* and upper (not shown) and lower 155*b* shoulders formed therein, and a wall of the housing 155 may have one or more holes formed therethrough.

The mandrel 160 may be disposed within the housing 155 and longitudinally movable relative thereto between a retracted position (not shown) and an extended position (shown). The mandrel 160 may have upper and lower shoulders 160*u,b* formed therein. A seat 185 may be fastened to the mandrel 160 for receiving a blocking member, such as a ball 140, launched by ball launcher 131*b* and pumped through the drill string 105. The seat 185 may include an inner fastener, such as a snap ring or segmented ring, and one or more intermediate and outer fasteners, such as dogs. Each intermediate dog may be disposed in a respective hole formed through a wall of the mandrel 160. Each outer dog may be disposed in a respective hole formed through a wall of cam 165. Each outer dog may engage an inner surface of the housing 155 and each intermediate dog may extend into a groove formed in an inner surface of the mandrel 160. The seat ring may be biased into engagement with and be received by the mandrel groove except that the dogs may prevent engagement of the seat ring with the groove, thereby causing a portion of the seat ring to extend into the mandrel bore to receive the ball 140. The mandrel 160 may also carry one or more fasteners, such as snap rings 161*a,b*. The mandrel 160 may also be rotationally connected to the housing 155.

The cam 165 may be a sleeve disposed within the housing 155 and longitudinally movable relative thereto between a retracted position (not shown), an orienting position (not shown), an engaged position (shown), and a released position (not shown). The cam 165 may have a shoulder 165*s* formed therein and a profile 165*p* formed in an outer surface thereof. The profile 165*p* may have a tapered portion for pushing a follower 170*f* radially outward and be fluted for pulling the follower radially inward. The follower 170*f* may have an inner tongue engaged with the flute. The cam 165 may interact with the mandrel 160 by being longitudinally disposed between the snap ring 161*a* and the upper mandrel shoulder 160*u* and by having a shoulder 165*s* engaged with the upper mandrel shoulder in the retracted position. A spring 140*c* may be disposed between a snap ring (not shown) and a top of the cam 165, thereby biasing the cam toward the engaged position. Alternatively, the cam profile 165*p* may be formed by inserts instead of in a wall of the cam 165.

A longitudinal piston 195 may be a sleeve disposed within the housing 155 and longitudinally movable relative thereto between a retracted position (not shown), an orienting position (not shown), and an engaged position (shown). The piston 195 may interact with the mandrel 160 by being longitudinally disposed between the snap ring 161*b* and the lower mandrel shoulder 160*b*. A spring 190*p*, may be disposed between the lower mandrel shoulder 160*b* and a top of the piston 195, thereby biasing the piston toward the engaged position. A bottom of the piston 195 may engage the snap ring 161*b* in the retracted position.

One or more ribs 155*r* may be formed in an outer surface of the housing 155. Upper and lower pockets may be formed in each rib 155*r* for the release 175 and the driver 180, respectively. The release 175, such as an arm, and the driver 180, such as a dog, may be disposed in each respective pocket in the retracted position. The release 175 may be pivoted to the housing by a fastener 176. The follower 170*f* may be disposed through a hole formed through the housing wall. The follower 170*f* may have an outer tongue engaged with a flute formed in an inner surface of the release 175, thereby accommodating pivoting of the release relative to the housing 155 while maintaining radial connection (pushing and pulling) between the follower and the release. One or more seals may be disposed between the follower 170*f* and the housing 155. The release 175 may be rotationally connected to the housing 155 via capture of the upper end in the upper pocket by the pivot fastener 176. Alternatively, the ribs 155*r* may be omitted and the mandrel profile 210*p* may have a length equal to, greater than, or substantially greater than a combined length of the release 175 and the driver 180.

An inner portion of the driver 180 may be retained in the lower pocket by upper and lower keepers fastened to the housing 155. Springs 191 may be disposed between the keepers and lips of the driver 180, thereby biasing the driver radially inward into the lower pocket. One or more radial pistons 170*p* may be disposed in respective chambers formed in the lower pocket. A port may be formed through the housing wall providing fluid communication between an inner face of each radial piston 170*p* and a lower face of the longitudinal piston 195. An outer face of each radial piston 170*p* may be in fluid communication with the wellbore. Downward longitudinal movement of the longitudinal piston 195 may exert hydraulic pressure on the radial pistons 170*p*, thereby pushing the drivers 180 radially outward.

A chamber 158*h* may be formed radially between the mandrel 160 and the housing 155. A reservoir 158*r* may be formed in each of the ribs 155. A compensator piston may be disposed in each of the reservoirs 158*r* and may divide the respective reservoir into an upper portion and a lower portion. The reservoir upper portion may be in communication with the wellbore 108 via the upper pocket. Hydraulic fluid may be disposed in the chamber 158*h* and the lower portions of each reservoir 158*r*. The reservoir lower portion may be in fluid communication with the chamber 158*h* via a hydraulic conduit formed in the respective rib. A bypass 156 may be formed in an inner surface of the housing 155. The bypass 156 may allow leakage around seals of the longitudinal piston 195 when the piston is in the retracted position (and possibly the orienting position). Once the longitudinal 195 piston moves downward and the seals move past the bypass 156, the longitudinal piston seals may isolate a portion of the chamber 158*h* from the rest of the chamber.

A spring 190*r* may be disposed against the snap ring 161*b* and the lower shoulder 155*b*, thereby biasing the mandrel 160 toward the retracted position. In addition to the spring 190*r*, a bottom of the mandrel 160 may have an area greater than a top of the mandrel 160, thereby serving to bias the mandrel 160 toward the retracted position in response to fluid pressure (equalized) in the housing bore. The cam profiles 165*p* and radial piston ports may be sized to restrict flow of hydraulic fluid therethrough to dampen movement of the respective cam 165 and radial pistons 170*p* between their respective positions.

Figure 10D:
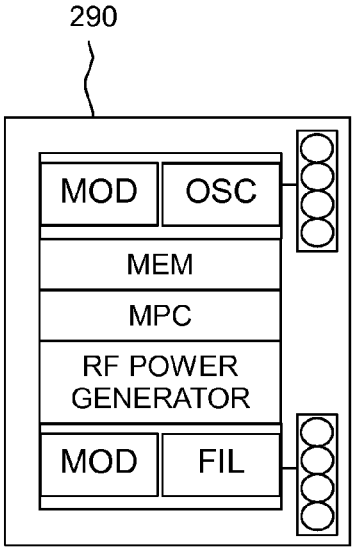
FIG. 10D illustrates a radio frequency identification (RFID) tag for communication with the sensor sub.
Figure 10A:
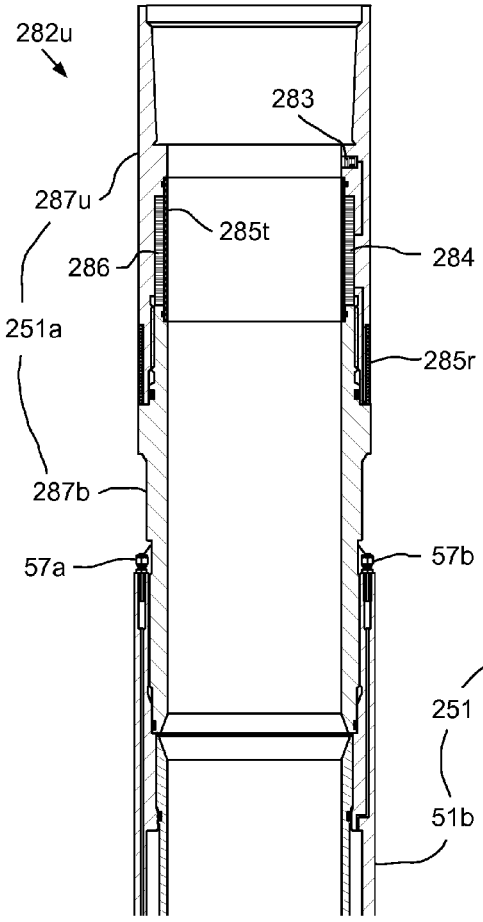
FIGS. 10A and 10B illustrate a modified isolation valve of the offshore drilling system.
Figure 10B:
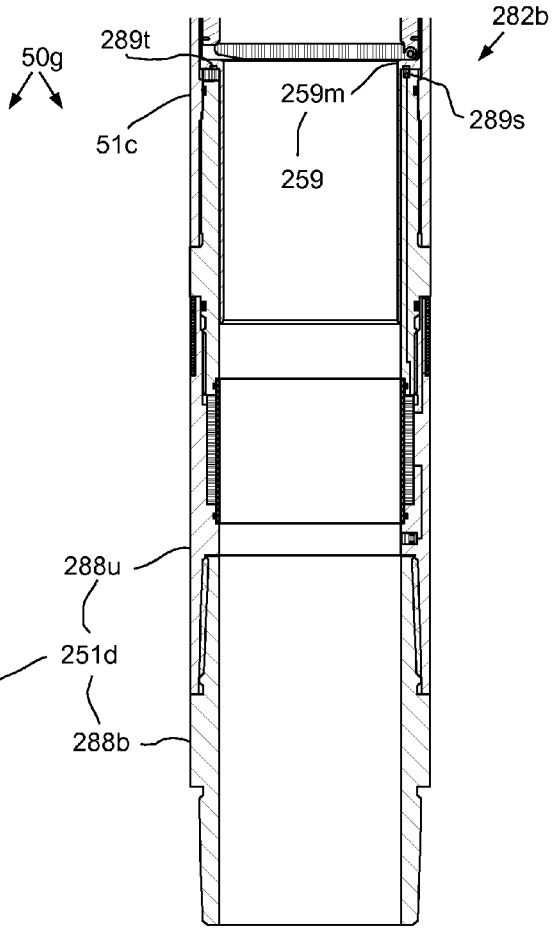

FIGS. 10A and 10B illustrate the isolation valve 50*g*. The isolation valve 50*g* may include a tubular housing 251, the flow sleeve 52, the piston 53, the flapper 54, the hinge 58, an abutment, such as lock sleeve shoulder 259*m*, the linkage 60, and the one or more wireless sensor subs, such as upper sensor sub 282*u* and lower sensor sub 282*b*. The housing 251 may be identical to the housing 51 except for the replacement of upper sensor sub housing 251*a* for upper adapter 51*a* the replacement of lower sensor sub housing 251*d* for lower adapter 51*d*. The lock sleeve 259 may be identical to the lock sleeve 59 except for the inclusion of a target 289*t* in a lower face of the shoulder 259*m*.

Figure 10C:
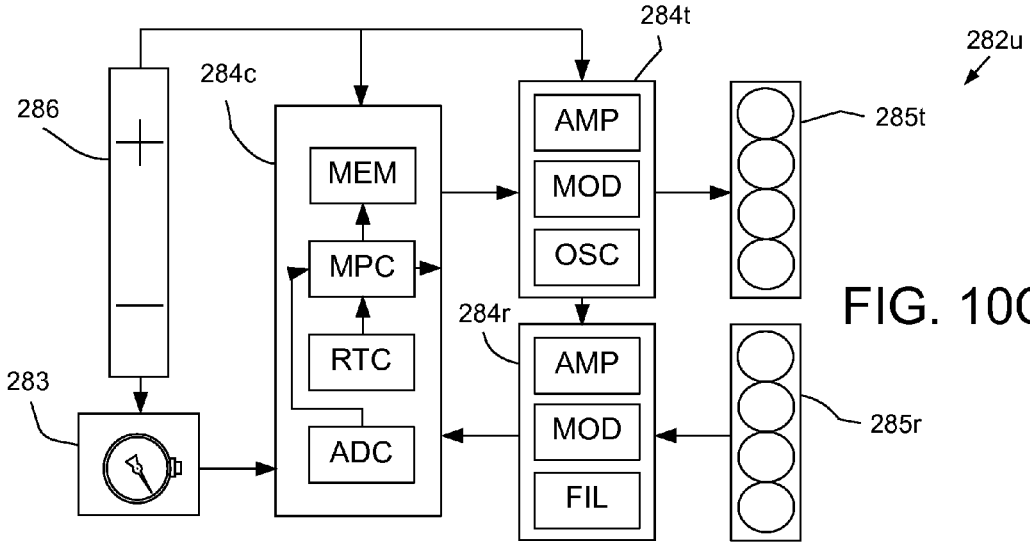
FIG. 10C illustrates a wireless sensor sub of the modified isolation valve.

FIG. 10C illustrates the upper wireless sensor sub 282*u*. The upper sensor sub 282*u* may include the housing 251*a*, a pressure sensor 283, an electronics package 284, one or more antennas 285*r,t*, and a power source, such as battery 286. Alternatively, the power source may be capacitor (not shown). Additionally, the upper sensor sub 282*u* may include a temperature senor (not shown).

The components 283-286 may be in electrical communication with each other by leads or a bus. The antennas 285*r,t* may include an outer antenna 285*r* and an inner antenna 285*t*. The housing 251*a* may include two or more tubular sections 287*u,b* connected to each other, such as by threaded couplings. The housing 251*a* may have couplings, such as threaded couplings, formed at a top and bottom thereof for connection to the body 51*b* and another component of the casing string 111. The housing 251*a* may have a pocket formed between the sections 287*u,b* thereof for receiving the electronics package 284, the battery 286, and the inner antenna 285*t*. To avoid interference with the antennas 285*r,t*, the housing 251*a* may be made from a diamagnetic or paramagnetic metal or alloy, such as austenitic stainless steel or aluminum. The housing 251*a* may have a socket formed in an inner surface thereof for receiving the pressure sensor 283 such that the sensor is in fluid communication with the valve bore upper portion.

The electronics package 284 may include a control circuit 284*c*, a transmitter circuit 284*t*, and a receiver circuit 284*r*. The control circuit 284*c* may include a microprocessor controller (MPC), a data recorder (MEM), a clock (RTC), and an analog-digital converter (ADC). The data recorder may be a solid state drive. The transmitter circuit 284*t* may include an amplifier (AMP), a modulator (MOD), and an oscillator (OSC). The receiver circuit 284*r* may include the amplifier (AMP), a demodulator (MOD), and a filter (FIL). Alternatively, the transmitter 284*t* and receiver 284*r* circuits may be combined into a transceiver circuit.

The lower sensor sub 282*b* may include the housing 251*d* having sections 288*u,b*, the pressure sensor 283, an electronics package 284, the antennas 285*r,t*, the battery 286, and a proximity sensor 289*s*. Alternatively, the inner antenna 285*t* may be omitted from the lower sensor sub 282*b*.

The target 289*t* may be a ring made from a magnetic material or permanent magnet and may be connected to the lock sleeve shoulder 259*m* by being bonded or press fit into a groove formed in the shoulder lower face. The lock sleeve may be made from the diamagnetic or paramagnetic material. The proximity sensor 289*s* may or may not include a biasing magnet depending on whether the target 289*t* is a permanent magnet. The proximity sensor 289*s* may include a semiconductor and may be in electrical communication with the bus for receiving a regulated current. The proximity sensor 289*s* and/or target 289*t* may be oriented so that the magnetic field generated by the biasing magnet/permanent magnet target is perpendicular to the current. The proximity sensor 289*s* may further include an amplifier for amplifying the Hall voltage output by the semiconductor when the target 289*t* is in proximity to the sensor. Alternatively, the proximity sensors may be inductive, capacitive, optical, or utilize wireless identification tags. Alternatively, the target may be embedded in an outer face of the flapper 54.

Once the casing string 111 has been deployed and cemented into the wellbore 108, the sensor subs 282*u,b* may commence operation. Raw signals from the respective sensors 283, 289*s* may be received by the respective converter, converted, and supplied to the controller. The controller may process the converted signals to determine the respective parameters, time stamp and address stamp the parameters, and send the processed data to the respective recorder for storage during tag latency. The controller may also multiplex the processed data and supply the multiplexed data to the respective transmitter 284*t*. The transmitter 284*t* may then condition the multiplexed data and supply the conditioned signal to the antenna 285*t* for electromagnetic transmission, such as at radio frequency. Since the lower sensor sub 282*b* is inaccessible to the tag 290 when the flapper 54 is closed, the lower sensor sub may transmit its data to the upper sensor sub 282*a* via its transmitter circuit and outer antenna and the sensor sub 282*a* may receive the bottom data via its outer antenna 285*r* and receiver circuit 284*r*. The sensor sub 282*a* may then transmit its data and the bottom data for receipt by the tag 290.

Alternatively, any of the other isolation valves 50*b-f* may be modified to include the wireless sensor subs 282*u,b*. Alternatively, any of the other isolation valves 50*a-f* may be assembled as part of the casing string 111 instead of the isolation valve 50*g*.

FIG. 10D illustrates the RFID tag 290 for communication with the upper sensor sub 282*u*. The RFD tag 290 may be a wireless identification and sensing platform (WISP) RFID tag. The tag 290 may include an electronics package and one or more antennas housed in an encapsulation. The tag components may be in electrical communication with each other by leads or a bus. The electronics package may include a control circuit, a transmitter circuit, and a receiver circuit. The control circuit may include a microcontroller (MCU), the data recorder (MEM), and a RF power generator. Alternatively, each tag 290 may have a battery instead of the RF power generator.

Once the lower formation 22*b* has been drilled to total depth (or the bit requires replacement), the drill string 105 may be removed from the wellbore 108. The drill string 105 may be raised until the drill bit is above the flapper 54 and the shifting tool 150 is aligned with the closer power sub 200*c*. The PLC 36 may then operate the ball launcher 131*b* and the ball 140 may be pumped to the shifting tool 150, thereby engaging the shifting tool with the closer power sub 200*c*. The drill string 105 may then be rotated by the top drive 13 to close the isolation valve 50*g*. The ball 140 may be released to the ball catcher. An upper portion of the wellbore 108 (above the flapper 54) may then be vented to atmospheric pressure. The PLC 36 may then operate the tag launcher 131*t* and the tag 290 may be pumped down the drill string 105.

Once the tag 290 has been circulated through the drill string 105, the tag may exit the drill bit in proximity to the sensor sub 282*u*. The tag 290 may receive the data signal transmitted by the sensor sub 282*u*, convert the signal to electricity, filter, demodulate, and record the parameters. The tag 290 may continue through the wellhead 110, the PCA 101*p*, and the riser 125 to the RCD 126. The tag 290 may be diverted by the RCD 236 to the return line 129. The tag 290 may continue from the return line 129 to the tag reader 132.

The tag reader 132 may include a housing, a transmitter circuit, a receiver circuit, a transmitter antenna, and a receiver antenna. The housing may be tubular and have flanged ends for connection to other members of the return line 129. The transmitter and receiver circuits may be similar to those of the sensor sub 282*u*. Alternatively, the tag reader 132 may include a combined transceiver circuit and/or a combined transceiver antenna. The tag reader 132 may transmit an instruction signal to the tag 290 to transmit the stored data thereof. The tag 290 may then transmit the data to the tag reader 132. The tag reader 132 may then relay the data to the PLC 36. The PLC 36 may then confirm closing of the valve 50*g*. The tag 290 may be recovered from the shale shaker 26 and reused or may be discarded. Additionally, a second tag may be launched before opening of the isolation valve 57*c* to ensure pressure has been equalized across the flapper 54.

Alternatively, the tag reader 132 may be located subsea in the PCA 101*p* and may relay the data to the PLC 36 via the umbilical 117.

Once the isolation valve 50*g* has been closed, the drill string 105 may be raised by removing one or more stands of drill pipe 5*p*. A bearing assembly running tool (BART) (not shown) may be assembled as part of the drill string 105 and lowered into the RCD 126 by adding one or more stands to the drill string 105. The (BART) may be operated to engage the RCD bearing assembly and the RCD latch operated to release the RCD bearing assembly. The RCD bearing assembly may then be retrieved to the rig 1*r* by removing stands from the drill string 105 and the BART removed from the drill string. Retrieval of the drill string 105 to the rig 1*r* may then continue.

FIGS. 11A-11C illustrate another modified isolation valve 50*h* having a pressure relief device 300, according to another embodiment of the present disclosure. The isolation valve 50*h* may include the housing 51, the flow sleeve 52, a piston 353, the flapper 54, the hinge 58, the linear guide 74, the lock sleeve 79, an abutment 378, and the pressure relief device 300. The piston 353 may be longitudinally movable relative to the housing 51. The piston 353 may include the head 53*h* and a sleeve 353*s* longitudinally connected to the head, such as fastened with threaded couplings and/or fasteners. The piston sleeve 353*s* may also have a flapper seat formed at a bottom thereof. The abutment 378 may be a ring connected to the lock sleeve 79, such by one or more fasteners. The abutment 378 may have a flapper support 378*f* formed in an upper face thereof for receiving an outer periphery of the flapper 54 and a hinge pocket 378*h* formed in the upper face for receiving the hinge 60. The flapper support 378*f* may have a curved shape complementary to the flapper curvature.

The pressure relief device 300 may include a relief port 301, a relief notch 378*r*, a rupture disk 302, and a pair of flanges 303, 304. The relief port 301 may be formed through a wall of the piston sleeve 353*s* adjacent to the flapper seat. The relief notch 378*r* may be formed in an upper portion of the abutment 378 to ensure fluid communication between the relief port 301 and a lower portion of the valve bore. The relief port 301 may have a shoulder formed therein for receiving the outer flange 304. The outer flange 304 may be connected to the piston sleeve 353*s*, such as by one or more fasteners. The rupture disk 302 may be metallic and have one or more scores 302*s* formed in an inner surface thereof for reliably failing at a predetermined rupture pressure. The rupture disk 302 may be disposed between the flanges 303, 304 and the flanges connected together, such as by one or more fasteners. The flanges 303, 304 may carry one or more seals for preventing leakage around the rupture disk 302. The rupture disk 302 may be forward acting and pre-bulged.

The rupture pressure may correspond to a design pressure of the flapper 54. The design pressure of the flapper 54 may be based on yield strength, fracture strength, or an average of yield and fracture strengths. The disk 302 may be operable to rupture 302*r* in response to an upward pressure differential (lower wellbore pressure 310*f* greater than upper wellbore pressure 310*h*) equaling or exceeding the rupture pressure, thereby opening the relief port 301. The open relief port 301 may provide fluid communication between the valve bore portions, thereby relieving the excess upward pressure differential which would otherwise damage the flapper 54. The rupture disk 302 may also be capable of withstanding a downward pressure differential (upper wellbore pressure greater than lower wellbore pressure) corresponding to the downward pressure differential capability of the valve 50.

Alternatively, the rupture disk 302 may be reverse buckling. Alternatively, the rupture disk 302 may be flat. Alternatively, the rupture disk 302 may be made from a polymer or composite material. Alternatively, the pressure relief device 300 may be a valve, such as a relief valve or rupture pin valve. Alternatively, the pressure relief device 300 may be a weakened portion of the piston sleeve 353*s* operable to rupture and open a relief port or deform away from engagement with the flapper 54, thereby creating a leak path. Alternatively, the pressure relief device 300 may be located in the flapper 54. Alternatively, the isolation valve 50*h* may include a second pressure relief device arranged in a series or parallel relationship to the device 300 and operable to relieve an excess downward pressure differential. Alternatively, any of the other isolation valves 50*a-g* may be modified to include the pressure relief device 300.

While the foregoing is directed to embodiments of the present disclosure, other and further embodiments of the disclosure may be devised without departing from the basic scope thereof, and the scope of the invention is determined by the claims that follow.

The invention claimed is:

1. An isolation valve for use in a wellbore, comprising:

a housing;

a piston longitudinally movable relative to the housing;

a flapper carried by the piston for operation between an open position and a closed position, the flapper operable to isolate an upper portion of a bore of the valve from a lower portion of the bore in the closed position;

an opener connected to the housing for opening the flapper; and an abutment independently movable from the piston and configured to receive the flapper in the closed position, thereby retaining the flapper in the closed position.

2. The isolation valve of claim 1, wherein:

the housing is tubular, the housing has a coupling at each end thereof for assembly as part of a casing string, the housing has a hydraulic chamber formed therein, and the piston has a portion disposed in the hydraulic chamber.

3. The isolation valve of claim 1, further comprising a hinge pivotally connecting the flapper to the piston.

4. The isolation valve of claim 1, further comprising a slide hinge coupling the flapper to the piston.

5. The isolation valve of claim 1, further comprising a spring biasing the flapper toward the closed position.

6. The isolation valve of claim 1, wherein:

the opener is a flow sleeve, and the piston is operable to move the flapper into engagement with the stationary flow sleeve, the flapper is pushed to the open position by the engagement, and the piston is further operable to move the flapper into a protective chamber formed between the flow sleeve and the housing.

7. The isolation valve of claim 6, wherein:

the valve further comprises a hinge, the flow sleeve has a tapered lower end, and the flow sleeve is oriented relative to the flapper to engage a portion of the flapper adjacent the hinge.

8. The isolation valve of claim 1, wherein:

the abutment is a shoulder of a lock sleeve operable to engage the housing, and the isolation valve further comprises a linkage coupling the lock sleeve to the piston.

9. The isolation valve of claim 1, wherein the abutment is a profile formed in the housing.

10. The isolation valve of claim 1, wherein:

the flapper is curved, and the abutment has a curvature complementary to a curvature of the flapper.

11. The isolation valve of claim 1, further comprising one of:

a seat formed in a lower end of the piston; and a cap connected to a lower end of the piston and having a seat formed therein, wherein the flapper seals against the seat in the closed position.

12. The isolation valve of claim 11, wherein the abutment has a port formed therethrough to prevent sealing between the flapper and the abutment.

13. The isolation valve of claim 1, wherein:

the abutment is a shoulder of a lock sleeve operable to engage the housing, and the isolation valve further comprises a latch fastening the lock sleeve to the housing.

14. The isolation valve of claim 1, further comprising a latch operable to fasten the piston to the housing.

15. The isolation valve of claim 1, further comprising a linear spring biasing the flapper toward the closed position, wherein the abutment is further operable to kickoff the flapper.

16. The isolation valve of claim 15, wherein the abutment is operable between an expanded position for kickoff of the flapper and a compressed position for receiving the closed flapper.

17. A system for use in drilling a wellbore, comprising:

the isolation valve of claim 1;

a hydraulic closer line connecting the isolation valve to a control station; and the control station comprising a microcontroller (MCU) operable to calculate a differential pressure across the flapper.

18. The isolation valve of claim 1, further comprising:

a lower wireless sensor sub having a proximity sensor for confirming closing of the flapper; and an upper wireless sensor sub for receiving the confirmation and operable to transmit the confirmation to a wireless identification tag.

19. The isolation valve of claim 1, further comprising a pressure relief device set at a design pressure of the flapper and operable to bypass the closed flapper.

20. An isolation assembly, comprising:

the isolation valve of claim 1; and a power sub for opening and/or closing the isolation valve and comprising:

a tubular housing having a bore formed therethrough;

a tubular mandrel disposed in the power sub housing, movable relative thereto, and having a profile formed through a wall thereof for receiving a driver of a shifting tool; and a piston operably coupled to the mandrel and operable to pump hydraulic fluid to the isolation valve piston.

21. A method of isolating a string in a wellbore, comprising:

deploying the string in the wellbore, the string having an isolation valve;

moving a piston of the isolation valve towards an abutment of the isolation valve;

moving the abutment independently of the piston;

closing a flapper of the isolation valve to isolate a bore of the valve; and engaging the flapper with the abutment when the flapper is in the closed position.

22. The method of claim 21, wherein the flapper seals against a seat of the isolation valve and does not seal against the abutment.

23. The method of claim 21, wherein:

hydraulic fluid is supplied to move the piston via a hydraulic control line, and the method further comprises:

shutting in the control line after closing the flapper; and determining a differential pressure across the closed flapper by monitoring pressure in the shut in control line.

24. The method of claim 21, wherein:

the casing string further has a power sub in fluid communication with the piston, the drill string further has a shifting tool, and hydraulic fluid is supplied to move the piston by driving the power sub with the shifting tool.

25. An isolation assembly for use in a wellbore, comprising:

an isolation valve, comprising:

a housing;

a piston longitudinally movable relative to the housing;

a flapper for operation between an open position and a closed position, the flapper operable to isolate an upper portion of a bore of the valve from a lower portion of the bore in the closed position;

a sleeve for opening the flapper; and a pressure relief device set at a design pressure of the flapper and operable to bypass the closed flapper; and a power sub for opening and/or closing the isolation valve and comprising:

a tubular housing having a bore formed therethrough;

a tubular mandrel disposed in the power sub housing, movable relative thereto, and having a profile formed through a wall thereof for receiving a driver of a shifting tool; and a piston operably coupled to the mandrel and operable to pump hydraulic fluid to the isolation valve piston.

* * * * *